US010353335B2

(12) United States Patent
Katayama

(10) Patent No.: US 10,353,335 B2
(45) Date of Patent: Jul. 16, 2019

(54) IMAGE FORMING APPARATUS

(71) Applicant: CANON KABUSHIKI KAISHA, Tokyo (JP)

(72) Inventor: Hiroki Katayama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/493,518

(22) Filed: Apr. 21, 2017

(65) Prior Publication Data

US 2017/0308034 A1 Oct. 26, 2017

(30) Foreign Application Priority Data

Apr. 22, 2016 (JP) ..... 2016-085650

(51) Int. Cl.

| | |
|---|---|
| ***G03G 15/00*** | (2006.01) |
| ***G03G 21/18*** | (2006.01) |
| ***G03G 21/16*** | (2006.01) |
| ***B65H 1/26*** | (2006.01) |
| ***B65H 5/38*** | (2006.01) |

(52) U.S. Cl.

CPC ..... *G03G 15/6502* (2013.01); *B65H 1/266* (2013.01); *B65H 5/38* (2013.01); *G03G 21/1604* (2013.01); *G03G 21/1623* (2013.01); *G03G 21/185* (2013.01); *B65H 2404/611* (2013.01); *B65H 2405/31* (2013.01);

(Continued)

(58) Field of Classification Search

CPC ..... G03G 15/6502; G03G 15/6508; G03G 15/6511; G03G 21/16; G03G 21/1638; G03G 2215/00383; G03G 2215/00396; G03G 2215/00544; G03G 2221/1672; B65H 1/04; B65H 3/06; B65H 3/56; B65H 3/66

USPC ..... 399/107, 124, 388, 393; 271/10.09, 109, 271/145, 264

See application file for complete search history.

(56) References Cited

U.S. PATENT DOCUMENTS 5,002,266 A * 3/1991 Kikuchi ..... B41J 13/00 271/109

2008/0259364 A1* 10/2008 Morita ..... G03G 21/185 358/1.9

(Continued)

FOREIGN PATENT DOCUMENTS

JP 2007-197162 A 8/2007

JP 2008-058892 A 3/2008

(Continued)

*Primary Examiner* — Benjamin R Schmitt

(74) *Attorney, Agent, or Firm* — Venable LLP

(57) ABSTRACT

An image forming apparatus includes a casing; a process unit for forming a developer image on a sheet; an image exposing unit; a sheet cassette detachably mounted to the casing; a feeding roller for single the sheet from the cassette; a feeding guide provided in the casing and configured to guide the sheet moving from the cassette to the process unit. The exposing unit is disposed right above the feeding roller. The process unit is at a position the same position as the exposing unit in the vertical direction and downstream of the exposing unit in a horizontal direction. The cassette is below the feeding roller. The guide is between the exposing unit and the cassette in the vertical direction. The guide includes upper and lower guides. When the cassette is drawn out of the casing, the lower guide moves to an accommodating portion in the cassette.

11 Claims, 16 Drawing Sheets

(52) U.S. Cl.
CPC .... *B65H 2601/11* (2013.01); *B65H 2601/321* (2013.01); *G03G 2215/00679* (2013.01)

(56) References Cited

U.S. PATENT DOCUMENTS

2012/0081760 A1* 4/2012 Asada ..... B41J 3/4071
358/471
2012/0326381 A1* 12/2012 Inoue ..... B65H 3/0607
271/117
2013/0140764 A1* 6/2013 Samoto ..... B65H 85/00
271/225

FOREIGN PATENT DOCUMENTS

JP 2013-032210 A 2/2013
JP 2015-036761 A 2/2015
JP 2015-036763 A 2/2015

* cited by examiner

IMAGE FORMING APPARATUS

FIELD OF THE INVENTION AND RELATED ART

The present invention relates to an image forming apparatus such as a copying machine, a printing machine, a facsimileing machine, etc.

In recent years, it has come to be desired to reduce an image forming apparatus in size so that the apparatus can be set up in various locations. In the case of the image forming apparatus disclosed in Japanese Laid-open Patent Application No. 2015-036761, it is regulated in the positioning of each of its various units. More specifically, the image forming apparatus comprises: a processing unit having a photosensitive member, an exposing unit for exposing the photosensitive member, and a fixing unit for fixing an image formed of developer on a sheet of recording medium, such as paper, with the use of the photosensitive member, to the sheet. These units are disposed directly above the recording medium feeding-conveying cassette, in which multiple sheets of recording medium are stored. Further, they are roughly horizontally disposed, in order to reduce the apparatus in dimension in terms of height.

It sometimes occurs that a sheet of recording medium gets stuck (which hereafter may be referred to as "jammed") in an image forming apparatus, and therefore, it becomes impossible for a sheet of recording medium to be conveyed through the apparatus. If a sheet of recording medium becomes jammed in an image forming apparatus, the jammed sheet of recording medium has be removed by a user him- or herself. Therefore, a structural arrangement for an image forming apparatus, which can make it easier for a user to remove the jammed sheet of recording medium in the apparatus, has been desired.

One of such structural arrangements for an image forming apparatus, which can make it easier for a user to remove a jammed sheet of recording medium in an image forming apparatus is disclosed in Japanese Laid-open Patent Application No. 2007-197162. According to this patent application, the image forming apparatus is structured so that its recording medium conveyance guide, which is a part of the recording medium conveyance passage, is movable. More specifically, it is structured so that as a sheet of recording medium becomes jammed in the straight portion of the recording medium conveyance passage, through which a sheet of recording medium is conveyed when an image is to be formed on the second surface of the sheet, its recording medium feeding-conveying cassette, in which multiple sheets of recording medium are stored, can be pulled out to remove the jammed sheet. Further, it is structured so that as the cassette is pulled out of the main assembly of the apparatus, a bottom guide, which is a part of the recording medium conveyance passage of the apparatus, is moved into the portion of the cassette, which is reserved for the bottom guide, in order to make it easier for a user to access the recording medium conveyance passage to remove the jammed sheet of recording medium.

However, in the case of the image forming apparatus disclosed in Japanese Laid-open Patent Application No. 2015-036761, as a sheet of recording medium is fed from within the recording medium feeding-conveying cassette into the main assembly of the image forming apparatus, the sheet is made to move through a bent portion of the recording medium passage, and then, is moved through the straight portion of the recording medium passage, which is between the cassette and each unit. Further, the exposing unit is disposed directly above the recording medium passage. Therefore, it is impossible for a user to access the recording medium passage from the top side of the passage to remove the jammed sheet of recording medium.

In the case of the image forming apparatus, disclosed in Japanese Laid-open Patent Application No. 2007-197162, which is structured so that a user can easily access the recording medium passage from the top side of the passage, the bottom conveyance guide, which is a part of the straight portion of the recording medium passage, moves into the portion of the interior of the recording medium feeding-conveying cassette, which is dedicated to the bottom conveyance guide. Thus, from the standpoint of the accessibility by a user to the bent portion of the recording medium conveyance passage, this apparatus is not as satisfactory as the one disclosed in Japanese Laid-open Patent Application No. 2015-036761. Thus, this apparatus is not satisfactory in that a user cannot access the recording medium conveyance passage from the bottom side of the passage to remove the jammed sheet of recording medium.

SUMMARY OF THE INVENTION

The present invention was made to solve the above-described problem. Thus, its primary object is to provide an image forming apparatus which is superior to any conventional image forming apparatus, in terms of how easily a jammed sheet of recording medium in the main assembly of the apparatus can be removed.

According to an aspect of the present invention, there is provided an image forming apparatus comprising a casing; a process unit detachably mounted to said casing, configured to form a developer image on a recording material and including a photosensitive member extending in a direction crossing with a vertical direction; an exposing unit configured to expose said photosensitive member to light; a cassette detachably mounted to said casing configured to accommodate the recording material to be fed to said process unit; a feeding rotatable member configured to separate and feeding a single recording material from said cassette; and a feeding guide provided in said casing and configured to guide the recording material moving from said cassette to said process unit, wherein said exposing unit is disposed right above said feeding rotatable member in the vertical direction, said process unit is disposed at a position which is substantially the same as said exposing unit in the vertical direction and which is downstream of said exposing unit in a horizontal direction, with respect to a feeding direction of the recording material, said cassette is disposed below said feeding rotatable member in the vertical direction, and said feeding guide is disposed between said exposing unit and said cassette in the vertical direction, wherein said feeding guide includes an upper guide configured to guide an upper surface of the recording material and a lower guide configured to guide a lower surface of the recording material, and wherein when said cassette is drawn out of said casing, said lower guide moves to an accommodating portion in said cassette.

Further features of the present invention will become apparent from the following description of exemplary embodiments with reference to the attached drawings.

DESCRIPTION OF THE EMBODIMENTS

Next, the present invention is described with reference to the image forming apparatus in the first embodiment of the present invention, with reference to drawings.

[Embodiment 1]

Figure 1:
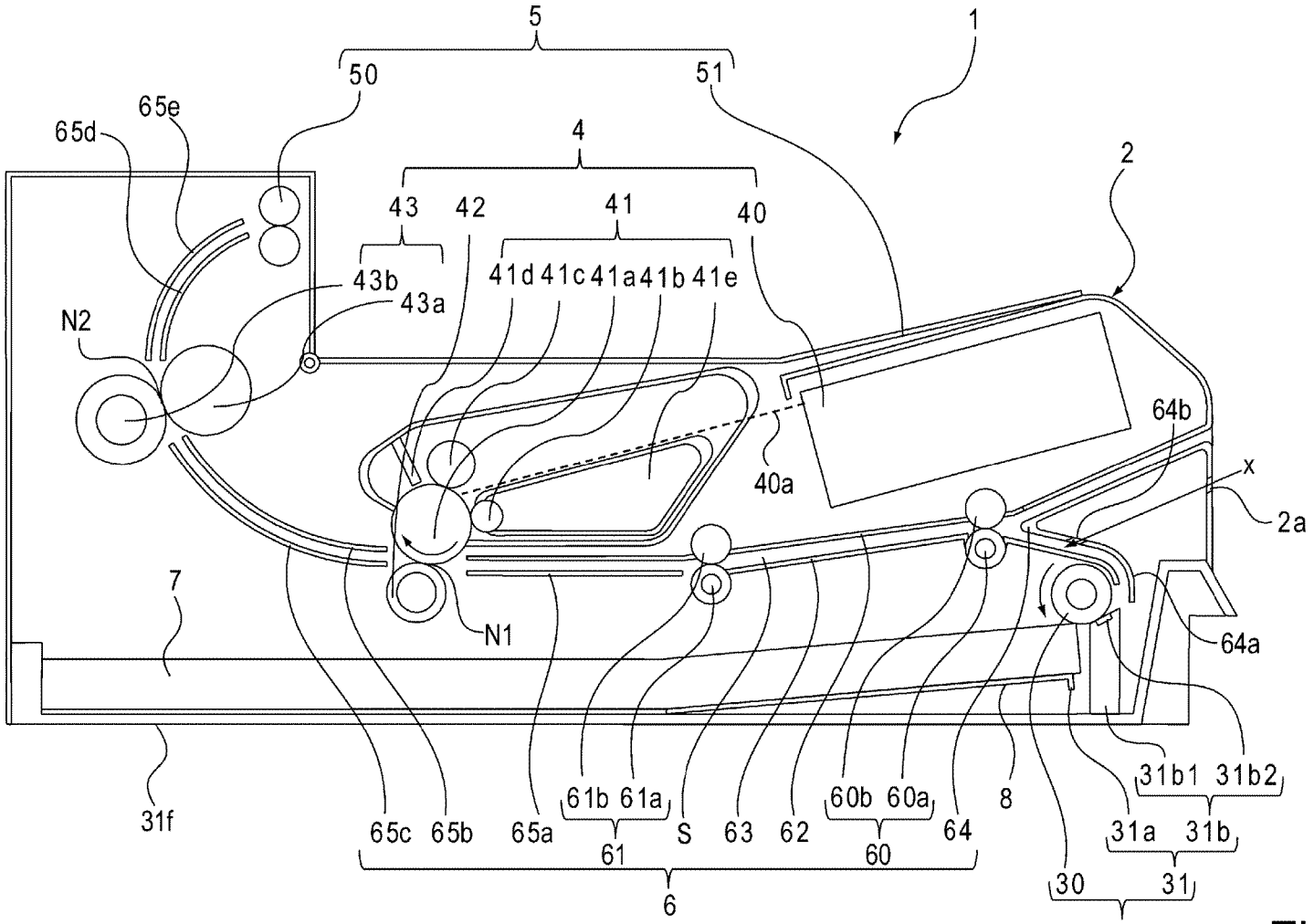
FIG. 1 is a sectional view of a typical image forming apparatus to which the present invention is applicable. It shows the general structure of the apparatus.

To begin with, referring to FIGS. 1-8, the structure of the image forming apparatus in the first embodiment of the present invention is described. The image forming apparatus shown in FIG. 1 is a laser beam printer. It is one of the examples of an image forming apparatus to which the present invention was applied. Regarding the orientation of the image forming apparatus in the following description of the apparatus, provided that the image forming apparatus shown in FIG. 1 is disposed on the horizontal surface, the right side of the image forming apparatus in FIG. 1 is the front side of the apparatus, and the left side of the apparatus is the rear side of the apparatus. Further, the left side of the image forming apparatus 1 is on the side of the apparatus 1 that is in an out of the page direction and the right side of the image forming apparatus 1 is on a side in an of the apparatus 1 that is in an into the page direction.

<Image Forming Apparatus>

The image forming apparatus 1 shown in FIG. 1 has a recording medium feeding-conveying portion 6 (which hereafter may be referred to simply as "conveying portion 6"), an image forming portion 4, and a discharging portion 5, which are supported by the casing 2 of the main assembly of the image forming apparatus 1. Further, the image forming apparatus 1 is provided with a recording medium feeding-conveying portion 3 (which hereafter will be referred to as "feeding-conveying portion 3"), which is installed into, or uninstalled from, the casing 2 of the main assembly of the image forming apparatus 1. Further, the casing 2 is provided with a slit 2*a*, through which ambient light is allowed to enter the casing 2 in the direction indicated by an arrow mark X in FIG. 1.

<Feeding-conveying Portion>

The feeding-conveying portion 3 is provided with a recording medium feeding-conveying cassette 31 (which hereafter may be referred to simply as "cassette 31), which is removably installable in the bottom portion of the casing 2. It is also provided with a feed roller 30, which is a rotational member which feeds sheets 7 of recording medium such as paper stored in the cassette 31, one by one into the conveying portion 6. More specifically, the sheets 7 of recording medium stored in the cassette 31 are fed into the main assembly of the image forming apparatus 1 one by one, by the feed roller 30 while being separated from each other by the coordination between the feed roller 30 and a separation pad 31*b*2. After being fed into the main assembly by the feeding-conveying portion 3, each sheet 7 of recording medium is conveyed to the image forming portion 4 by the conveying portion 6.

<Cassette>

The cassette 31 is provided with a lift 31*a* which causes a middle plate 8 on which sheets 7 of recording medium are mounted in layers, to move up or down, and a separating portion 31*b* which separates sheets 7 in coordination with the feed roller 30. The separating portion 31*b* is provided with the separation pad 31*b*2 which separates the sheets 7 one by one by being pressed against the feed roller 30, and a separation pad holder 31*b*1 which supports the separation pad 31*b*2. In terms of the vertical direction (upward and downward direction in FIG. 1), the cassette 31 is disposed on the bottom side of the feed roller 30 (sheet feeding-conveying rotational member).

The sheet feeding portion 3 is disposed in the feeding-conveying cassette 31. It lifts the sheets 7 of recording medium loaded in layers on the middle plate 8 to keep the sheets 7 pressed upon the feeding-conveying roller 30. As the feeding-conveying roller 30 is rotated in the counter-clockwise direction in FIG. 1, the sheets 7 are moved out of the feeding-conveying roller 30 from the cassette 31 while being separated from each other. Then, each sheet 7 of recording medium is conveyed from the feeding-conveying portion 3 to the conveying portion 6. Then, the sheet 7 is supplied to a process cartridge 41 (processing unit) by the conveying portion 6.

<Separating Portion>

Figure 2:
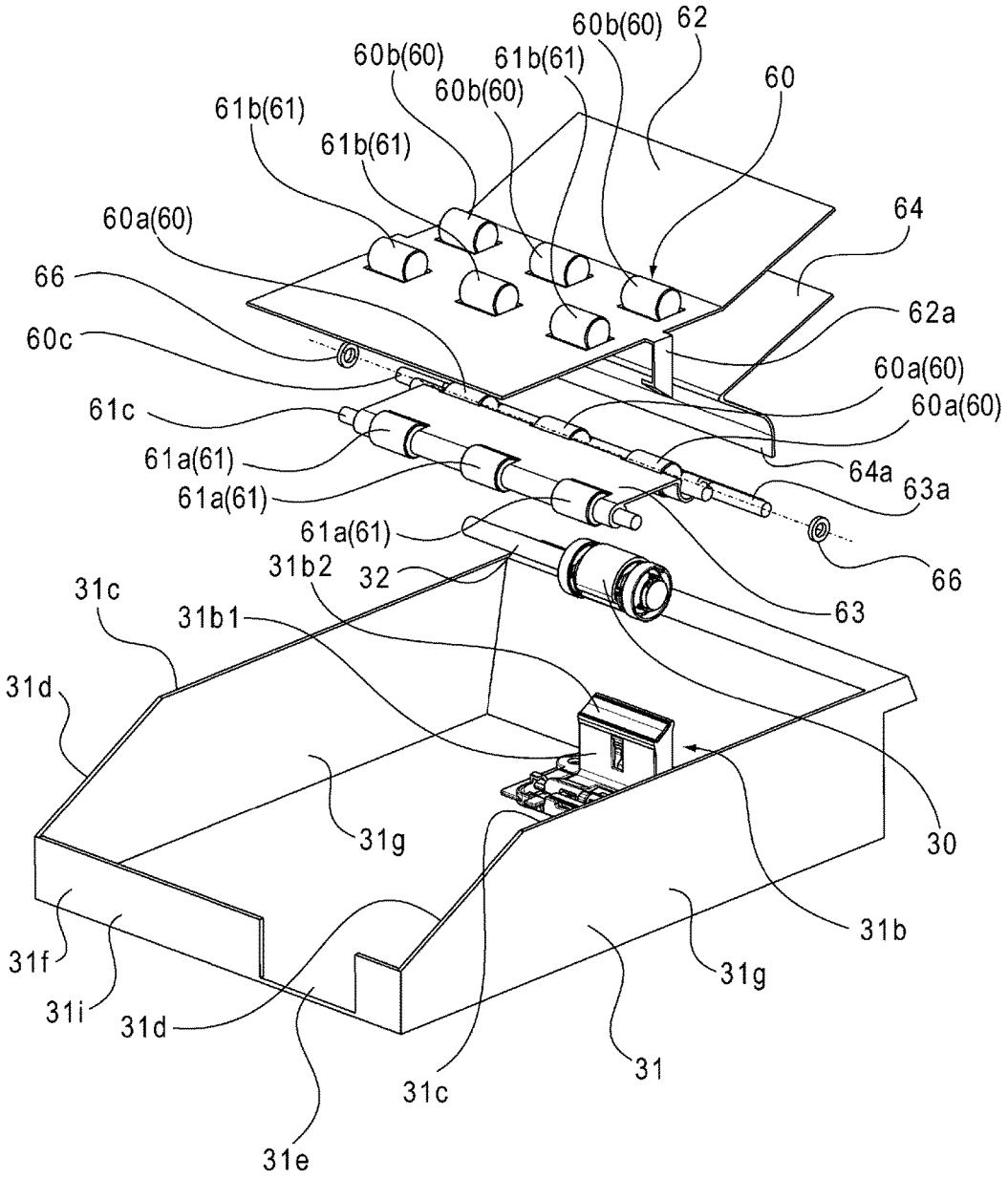
FIG. 2 is an exploded perspective of the recording medium feeding-conveying portion of the image forming apparatus in the first embodiment of the present invention, as seen from the top side of the recording medium feeding-conveying portion, when the recording medium feeding-conveying cassette is in its preset recording medium feeding-conveying position in the casing of the apparatus. It shows the structure of the means for rotationally moving the bottom guide of the recording medium conveyance passage of the apparatus.

Referring to FIG. 2, the separating portion 31*b* is fixed to the bottom plate 31*f* of the feeding-conveying cassette 31. It feeds the sheets 7 of recording medium one by one into the main assembly of the image forming apparatus 1, while separating the sheets 7 from each other by the coordination of the separation pad 31*b*2 supported by the separation pad holder 31*b*1 and the feeding-conveying roller 30. The rotational shaft 60*c* of a conveyance roller 60*a* (shown in FIG. 2) and the rotational shaft 61*b* of the registration roller 61*a* are rotatably supported on their lengthwise ends by the casing 2. They are rotationally driven by a motor (unshown), which functions as a driving force source.

The conveyance roller 60*a* and registration roller 61*a* rotate together about their rotational shafts 60*c* and 61*c*, respectively. The conveyance roller 60*b* and registration roller 61*b* are disposed in a manner to oppose the conveyance roller 60*a* and registration roller 61*a*, and are kept pressed upon the conveyance roller 60*a* and registration roller 61*a*, respectively, by unshown compression springs which function as pressing means. Thus, each sheet 7 of recording medium is pinched by the pair of conveyance rollers 60 and pair of registration roller 61. Therefore, as the conveyance roller 60*a* and registration roller 61*a* are rotated, the sheet 7 is conveyed to the image forming portion 4.

<Image Forming Portion>

The image forming portion 4 shown in FIG. 1 has: a laser scanner unit 40 (exposing unit) which is an exposing means; and the process cartridge 41 (processing unit) which is removably installable in the casing 2 of the main assembly of the image forming apparatus 1. Further, the image forming portion 4 has: a transfer roller 42 which is a transferring means; and a fixing apparatus 43 which is a fixing means. The image forming portion 4 forms a toner image on a sheet 7 of recording medium, based on the information of an image to be formed.

<Exposing Unit>

Referring to FIG. 1, in terms of the vertical direction (upward-downward direction in FIG. 1), the laser scanner unit 40 which is an exposing unit is disposed directly above the feeding-conveying roller 30 (rotational feeding-conveying member). In terms of the frontward-backward direction, it is disposed in the front portion (right portion in FIG. 1) of the casing 2. That is, the laser scanner unit 40 is disposed so that, in terms of the upward-downward direction in FIG. 1, it overlaps with the feeding-conveying roller 30.

The laser scanner unit 40 projects a beam 40*a* of laser light toward the peripheral surface of the photosensitive drum 41*a* (photosensitive member), which is an image bearing member disposed in the process cartridge 41 so that it can be rotated in the clockwise direction in FIG. 1, while modulating the beam 40*a* according to the data of the image to be formed, to expose the photosensitive member.

<Processing Unit>

The process cartridge 41 which is a processing unit is structured as an image forming means which forms a developer image (toner image) on a sheet 7 of recording medium. The process cartridge 41 is provided with the photosensitive drum 41*a* which is a photosensitive member. The photosensitive drum 41*a* is rotatably disposed in the process cartridge 41 in such an attitude that it extends in a direction that is in and out of the page, that is, the direction which intersects the vertical direction (upward-downward direction in FIG. 1). The photosensitive drum 41*a* is rotatable in the clockwise direction in FIG. 1. Further, the process cartridge 41 is provided with a changing roller 41*c* which is a charging means, a cleaning blade 41*d* which is a cleaning means, and a developer storing portion 41*e* which stores developer (toner). The process cartridge 41 is removably attached to the casing 2 of the main assembly of the image forming apparatus 1.

Referring to FIG. 1, the image forming apparatus 1 is structured so that when the process cartridge 41 is in its preset position (image forming position) in the casing 2, it roughly overlaps with the laser scanner unit 40 (exposing unit) in terms of the vertical direction (the upward-downward direction in FIG. 1).

Further, in terms of the horizontal direction (left-right direction in FIG. 1), the process cartridge 41 is disposed on the downstream side of the laser scanner unit 40 (exposing unit) in terms of the direction in which a sheet 7 of recording medium is conveyed (leftward in FIG. 1). That is, the process cartridge 4 is disposed in the rear portion of the main assembly of the image forming apparatus 1, being on the rear side (left side in FIG. 1) of the laser scanner unit 40 (exposing unit). In terms of the vertical direction (upward-downward direction), the process cartridge 41 is disposed in the top portion (top side in FIG. 1) of the main assembly of the image forming apparatus 1, being on the top side of the feeding-conveying cassette 31. In terms of the front-rear direction (left-right direction in FIG. 1) of the main assembly of the image forming apparatus 1, the process cartridge 41 is disposed so that it overlaps with the laser scanner unit 40.

<Image Forming Operation>

The photosensitive drum 41*a* is rotationally driven in the clockwise direction of FIG. 1. As it is rotated, its peripheral surface is uniformly charged by the changing roller 41*c*. Then, the uniformly charged portion of the peripheral surface of the photosensitive drum 41*a* is exposed to the beam 40*a* of laser light emitted by the laser scanner unit 40 while being modulated according to the information of the image to be formed. Consequently, an electrostatic latent image is effected on the peripheral surface of the photosensitive drum 41*a*. Then, the electrostatic latent image formed on the peripheral surface of the photosensitive drum 41*a* is supplied with the toner from the developer storing portion 41*e*, by a development roller 41*b*, whereby the electrostatic latent image on the peripheral surface of the photosensitive drum 41*a* is developed into a visible image, that is, an image formed of toner (which hereafter will be referred to as "toner image").

Meanwhile, each sheet 7 of recording medium fed into the main assembly of the image forming apparatus 1 by the feeding-conveying portion 3 is conveyed by the pair of conveyance rollers 60 (rotational conveying members), with which the conveying portion 6 is provided, while remaining pinched by the pair, to the pair of registration rollers 61 which are temporarily kept stationary. As the sheet 7 is conveyed to the pair of registration roller 61, the leading end of the sheet 7 runs into the nip between the pair of registration roller 61. Consequently, the sheet 7 is corrected in attitude by the coordination of the nip and the resiliency of the sheet 7, if the sheet 7 is askew. Thereafter, the pair of registration rollers 61 begin to be rotated with present timing. Thus, the sheet 7 is conveyed further by the pair of registration rollers 61, and put through a transfer nip N1 formed by the peripheral surface of the photosensitive drum 41*a* and the transfer roller 42, while remaining pinched by the pair of registration rollers 61. As the sheet 7 is conveyed through the transfer nip N1, transfer bias is applied to the transfer roller 42, whereby the toner image on the peripheral surface of the photosensitive drum 41*a* is transferred onto the sheet 7.

After the transfer of the toner image onto the sheet 7 of recording medium, the sheet 7 is conveyed through the fixation nip portion N2 formed by the heat roller 43*a* and pressure roller 43*b*, with which the fixing apparatus 43 is provided. As the sheet 7 is conveyed through the fixation nip portion N2, the sheet 7 and the toner image thereon are heated and pressed, whereby the toner image is thermally melted. Then, as the toner image cools down, it becomes fixed to the sheet 7. After the thermal fixation of the toner image to the sheet 7, the sheet 7 is conveyed further, and is discharged onto the delivery tray 51 by being conveyed by a pair of discharge rollers 50 while being pinched by the discharge rollers 50. The toner which was not transferred from the photosensitive drum 41*a*, being therefore remaining on the peripheral surface of the photosensitive drum 41*a*, is scraped away by a cleaning blade 41*d*.

<Conveyance Guide>

The conveying portion 6 includes the pair of conveyance rollers 60, which are rotational conveying members, and the pair of registration rollers 61. It has also a top guide 62 (conveyance guide) which extends from the front portion (right side in FIG. 1) of the main assembly of the image forming apparatus 1 to the adjacencies of the transfer nip portion N1. The mid portion of the top guide 62 is provided with the pair of conveyance rollers 60 and pair of registration roller 61. Further, the conveying portion 6 is provided with a bottom guide 63 (conveyance guide) which opposes the top guide 62. The bottom guide 63 extends from the adjacencies of the feeding-conveying roller 30 to the adjacencies of the pair of registration rollers 61. The mid portion of the bottom guide 63 is provided with the pair of conveyance rollers 60. Further, the conveying portion 6 is provided with a front guide 64 (conveyance guide), which is disposed in the front side (right side in FIG. 1). The front guide 64 has such a shape that enables the front guide 64 to oppose both the top and bottom guides 62 and 63, respectively. In cross-section, the front guide 64 appears like a bracket, having a shape like "<" (a Japanese letter "ku").

Further, the conveying portion 6 has a bottom guide 65*a* (conveyance guide), which is disposed so that it opposes the top guide 62. The bottom guide 65*a* extends from the adjacencies of the pair of registration rollers 61 to the adjacencies of the transfer nip portion N1. Moreover, the conveying portion 6 has the top and bottom guides 65*b* and 65*c*, respectively, which are disposed in a manner to oppose each other. The top guide 65*b* and bottom guide 65*c*extend from the adjacencies of the transfer nip portion N1 to the adjacencies of the fixation nip portion N2. Further, the conveying portion 6 has guides 65*d* and 65*e*, which are disposed in a manner to oppose each other. The guides 65*d* and 65*e* extend from the adjacencies of the fixation nip portion N2 to the adjacencies of the pair of discharge rollers 50. Next, referring to FIGS. 7 and 8, the conveying portion 6 has a bottom guide 67, which is supported by the casing 2 in a manner to oppose the top guide 64*a* of the front guide 64. The bottom guide 67 extends from the adjacencies of the feeding-conveying roller 30 to the adjacencies of the pair of conveyance rollers 60.

The casing 2 has a conveyance guide, which guides a sheet 7 of recording medium through the recording medium conveyance passage S, which extends from the feeding-conveying cassette 31 (cassette) to the process cartridge 41 (processing unit), by being contacted by the top or bottom surface of the sheet 7. These conveyance guides are made up of the bottom guide 63, front guide 64, top guide 62, bottom guide 65*a*, etc. Among these conveyance guides, the top guide 62 and bottom guide 63 are disposed between the laser scanner unit 40 (exposing unit) and feeding-conveying cassette 31 (cassette), in terms of the vertical direction (upward-downward direction in FIG. 1). The top guide 62 guides a sheet 7 of recording medium as the sheet 7 comes into contact with the top guide 62 by its top surface, whereas the bottom guide 63 guides the sheet 7 as the sheet 7 comes into contact with the bottom guide 63 by its bottom surface, while the sheet 7 is conveyed between the top and bottom guides 62 and 63.

Figure 8:
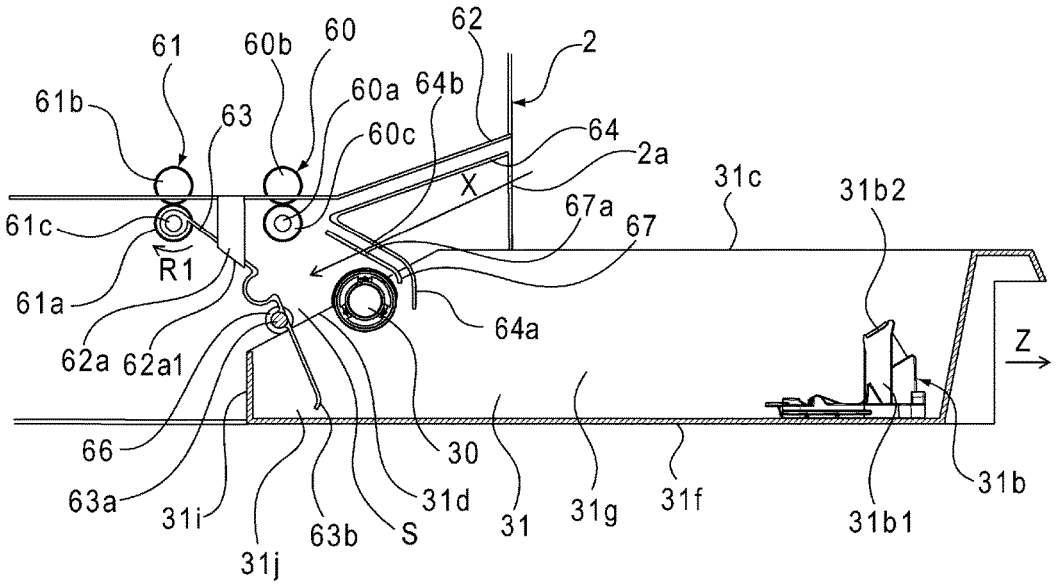
FIG. 8 is a sectional view of the combination of the recording medium feeding-conveying cassette and recording medium feeding-conveying portion in the first embodiment, at the vertical plane A-A in FIG. 4, when the bottom guide is in its retracted state.

Referring to FIG. 8, in this embodiment, if it is necessary for the feeding-conveying cassette 31 (cassette) in the casing 2 to be moved out of the casing, it is to be pulled by a user in the direction indicated by an arrow mark Z in FIG. 8. As the cassette 31 is pulled, the bottom guide 63 is made to rotate by its own weight in the direction indicated by an arrow mark R1 about the rotational shaft 61*c* of the registration roller 61*a*. Consequently, the bottom guide 63 rotates in such a manner that its front end portion moves into a storing portion 31*j*, which is in the adjacencies of the inward side of the rear plate 31*i* of the cassette 31.

As a sheet 7 of recording medium is fed into the main assembly of the image forming apparatus 1, the conveying portion 6 conveys the sheet 7 to the image forming portion 4. Then, it conveys the sheet 7 to the fixing apparatus 43 after the transfer of a toner image onto the sheet 7 by the image forming portion 4. Then, it conveys the sheet 7 to the discharging portion 5 after the thermal fixation of the toner image to the sheet 7 by the fixing apparatus 43. The conveyance guides, with which the conveying portion 6 is provided, guide the sheet 7 while the sheet 7 is conveyed through the main assembly of the image forming apparatus 1. In this embodiment, the recording medium conveyance passage S, through which the sheet 7 is conveyed from the feeding-conveying cassette 31 to the delivery tray 51, is shaped so that it looks like a letter "S" in cross-section in FIG. 1.

<Moving Means>

Figure 5:
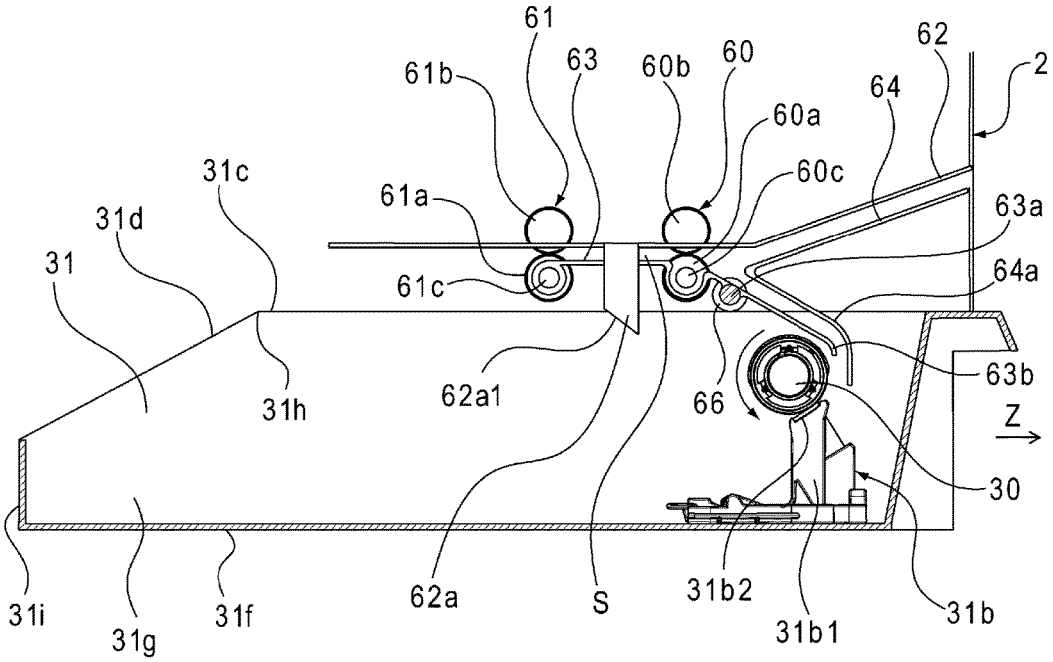
FIG. 5 is a sectional view of a combination of the recording medium feeding-conveying cassette and recording medium feeding-conveying portion, in the first embodiment, at a vertical plane A-A in FIG. 4, when the bottom guide is in its normal position (recording medium guiding position).

Referring to FIG. 5, the bottom guide 63 in this embodiment can be switched in position by a moving means between its normal position, shown in FIG. 5, in which it plays the role of a conveyance guide for guiding a sheet 7 of recording medium, and its retraction position, shown in FIG. 8, into which it is moved to make it easier for a user to remove a jammed sheet 7 of recording medium in the recording medium conveyance passage S.

Figure 3:
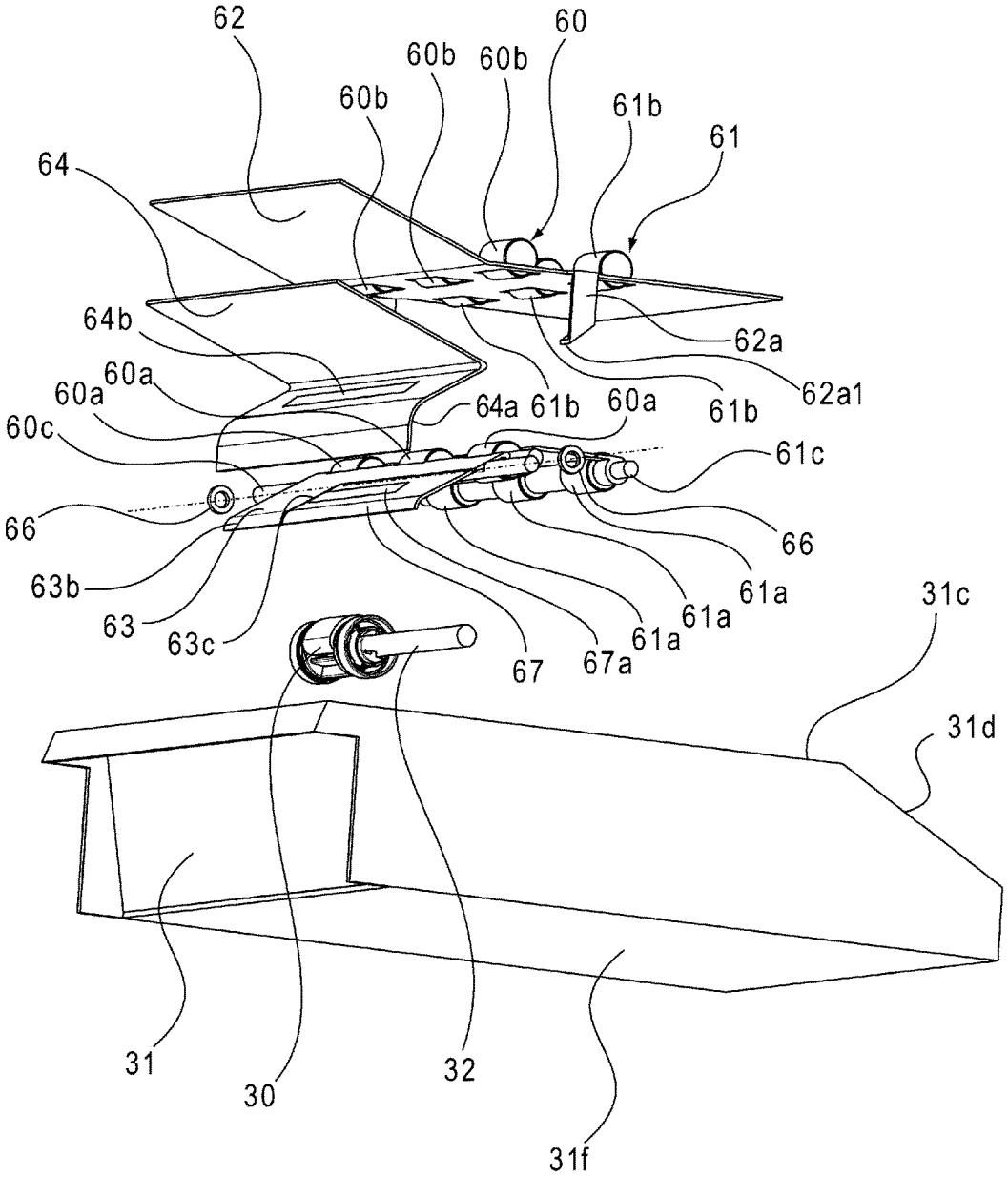
FIG. 3 is an exploded perspective of the recording medium feeding-conveying portion of the image forming apparatus in the first embodiment of the present invention, as seen from the bottom side of the recording medium feeding-conveying portion, when the recording medium feeding-conveying cassette is in its preset recording medium feeding-conveying position in the casing of the apparatus. It shows the structure of the means for rotationally moving the bottom guide of the recording medium conveyance passage of the apparatus.

First, referring to FIGS. 2 and 3, the structure of the means for rotationally moving the bottom guide 63 is described. FIG. 2 is an exploded perspective view of a combination of the conveying portion 6 and feeding-conveying cassette 31 in this embodiment, as seen from the top side of the combination, when the feeding-conveying cassette 31 is in its preset position (sheet feeding position) in the casing 2. It is for showing the structure of the means for rotationally moving the bottom guide 63. FIG. 3 is an exploded perspective view of the combination of the conveying portion 6 and feeding-conveying cassette 31 in this embodiment, as seen from the bottom side of the combination, when the feeding-conveying cassette 31 is in its preset position (sheet feeding position) in the casing 2. It is for showing the structure of the means for rotationally moving the bottom guide 63.

Referring to FIGS. 2 and 3, the rotational shaft 32 of the feeding-conveying roller 30 is rotatably cantilevered to the casing 2. It is rotationally driven by an unshown motor as a driving force source. As it is driven, it rotates with its rotational shaft 32 about the rotational shaft 32 to feed a sheet 7 of recording medium into the main assembly of the image forming apparatus 1. More specifically, multiple sheets 7 of recording medium are loaded in layers on the mid plate 8 of the feeding-conveying cassette 31, which is under the upward pressure generated by the lift 31*a*. Thus, as the feed roller 30 is rotationally driven, it feeds the sheets 7 one by one into the conveying portion 6 while separating the sheets 7 in coordination with the separation pad 31*b*2.

Referring to FIG. 1, the feeding-conveying cassette 31 (cassette) holds multiple sheets 7 of recording medium. It is removably installable in the bottom portion of the casing 2. Referring to FIG. 2, the feeding-conveying cassette 31 has: the bottom plate 31*f* and a pair of lateral plates 31*g* which are perpendicular to the bottom plate 31*f* The upwardly facing surface of each lateral plate 31*g*, has two sections, more specifically a horizontal section 31*c*(which hereafter will be referred to as horizontal guiding surface 31*c*) and a slant section (which hereafter will be referred to as slant guiding surface 31*d*) tilted by a preset angle relative to the horizontal guiding surface 31*c*). The horizontal guiding surface 31*c* and slant guiding surface 31*d* regulate the bottom guide 63 in attitude (angle). Further, the rear plate 31*i* of the feeding-conveying cassette 31 is provided with an opening as a conveyance guide escape 31*e*.

Figure 7:
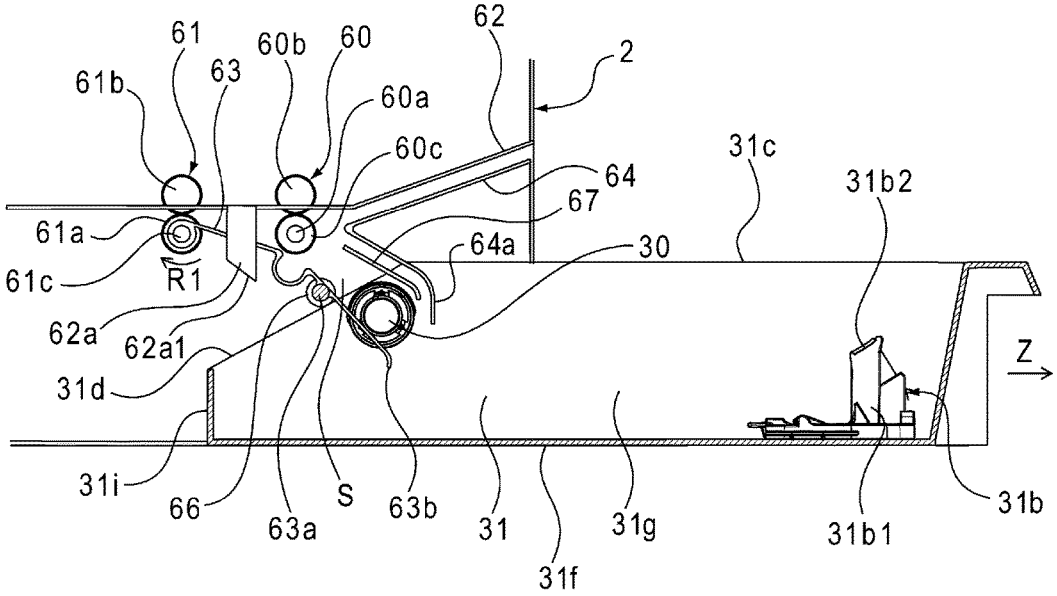
FIG. 7 is a sectional view of the combination of the recording medium feeding-conveying cassette and recording medium feeding-conveying portion in the first embodiment, at the vertical plane A-A in FIG. 4, when the bottom guide is being rotationally retracted from its normal position (recording medium guiding position).

The front guide 64, which is a conveyance guide, is supported by the casing 2. As multiple sheets 7 of recording medium are fed one by one rightward into the main assembly of the image forming apparatus 1 from the feeding-conveying cassette 31, while being separated by the coordination between the feeding-conveying roller 30 and separation pad 31*b*2, the front guide 64 causes each sheet 7 to U-turn (move leftward in FIG. 1), and guides the sheet 7 to the pair of conveyance rollers 60. The bottom guide 67 shown in FIGS. 7 and 8 is supported by the casing 2. It makes up a part of the conveyance guide which guides each sheet 7 from the feeding-conveying cassette 31 to the pair of conveyance rollers 60.

Each of the front guide 64 and bottom guide 67 is provided with slits 64*b* and 67*a* (openings), respectively, through which ambient light is allowed to enter the conveyance passage S in the direction indicated by an arrow mark X in FIG. 8. The top guide 62 is supported by the casing 2. It is provided with a pair of protrusive portions 62*a* which regulate the bottom guide 63 in attitude. The pair of protrusive portions 62*a* protrude downward from the lateral edges of the top guide 62, one for one, in terms of the direction parallel to the widthwise direction of the top guide 62 (upward-downward direction in FIG. 4, which is parallel to widthwise direction of sheet 7), in the direction which is perpendicular to the recording medium conveyance direction (left-right direction in FIG. 4).

The bottom guide 63 is made to rotationally (pivotally) move about the rotational shaft 61*c* of the registration roller 61*a* until it comes into contact with the engaging portion 62*a*1, which is the bottom portion of the protrusive portion 62*a* which protrudes downward from the edge of the top guide 62 in terms of the widthwise direction of the top guide 62, and which is J-shaped in cross section. Thus, the bottom guide 63 is held in such an attitude that its front end portion remains in the storing portion 31*j* in the adjacencies of the rear plate 31*i* in the feeding-conveying cassette 31.

Figure 4:
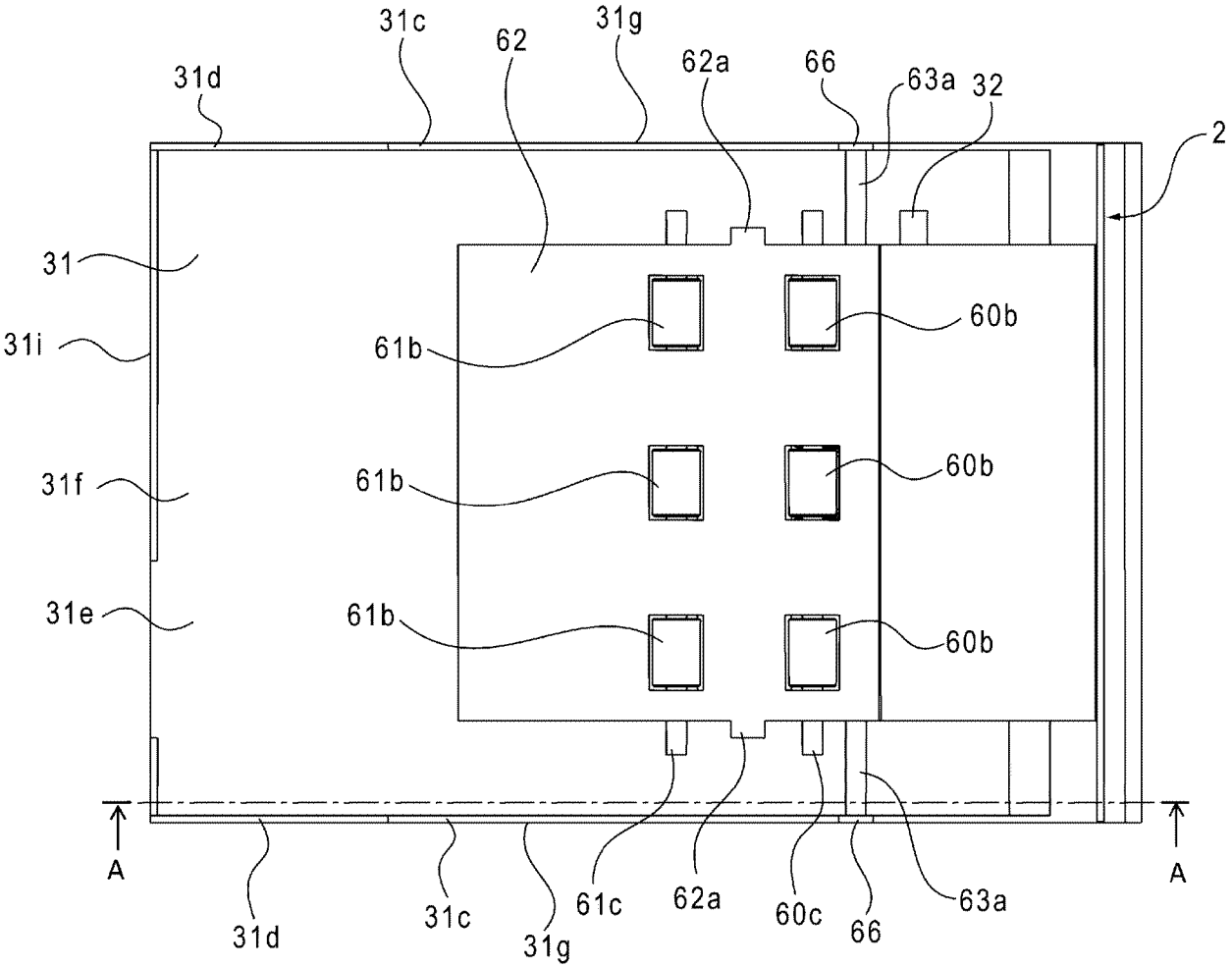
FIG. 4 is a top view of the bottom guide moving means in the first embodiment, when the bottom guide is in its normal position (recording medium guiding position). It shows the structure of the bottom guide moving means.

Referring to FIG. 5, the top guide 62 guides a sheet 7 of recording medium to the pair of registration rollers 61 while the sheet 7 is conveyed by the pair of conveyance rollers 60, remaining pinched by the rollers 60. Referring to FIGS. 5-8, the bottom guide 63 is supported by its downstream end (left end in FIG. 5), in terms of the recording medium conveyance direction, so that it is allowed to pivot about the rotational shaft 601*c* of the registration roller 61*a*. The mid portion of the bottom guide 63, in terms of the recording medium conveyance direction (left-right direction in FIG. 5), is provided with a bottom guide supporting shaft 63*a*. Referring to FIG. 4, the lengthwise end portions of this supporting shaft 63*a* are fitted with a pair of rotational regulation rollers 66, one for one.

Referring to FIGS. 5-8, the image forming apparatus 1 is structured so that the pair of regulation rollers 66 rotate on the horizontal guiding surface 31*c* and slant guiding surface 31*d*, which make up the upwardly facing surface of each of the lateral plates 31*g* of the feeding-conveying cassette 31. Thus, as a user draws outward the feeding-conveying cassette 31 in the main assembly of the image forming apparatus 1 in the direction indicated by an arrow mark Z in FIGS. 5-8 as shown in FIG. 5, the regulation rollers 66 rotate on the corresponding horizontal guiding surfaces 31*c* as the horizontal guiding surfaces 31*c* move in the direction indicated by the arrow mark Z in FIG. 5. As the border line between the horizontal guiding surface 31*c* and slant guiding surface 31*d*, shown in FIG. 6, moves past the regulation rollers 66, the regulation rollers 66 begin to rotate on the slant guiding surface 31*d* as the slant guiding surface 31*d* moves in the direction indicated by the arrow mark Z in FIGS. 7 and 8.

Consequently, the bottom guide 63 pivotally moves in the direction indicated by the arrow mark R1 in FIGS. 7 and 8 about the rotational shaft 61*c* of the registration roller 61*a* in a manner to retract away from the top guide 62. That is, as the feeding-conveying cassette 31 in the casing 2 is drawn outward of the casing 2 by a user, the bottom guide 63 retracts from the top guide 62 in such a manner that its rear portion (upstream end portion, in terms of the recording medium conveyance direction) moves into the storing portion 31*j* which is the adjacencies of the rear plate 31*i*, in the feeding-conveying cassette 31. In other words, the front guide 64 pivotally moves in a manner of separating from the top guide 62. On the other hand, the bottom guide 67 is immovably attached to the casing 2. Therefore, it remains opposing the top guide 64*a* of the front guide 64.

That is, in this embodiment, as the feeding-conveying cassette 31 (cassette) in its preset position (recording medium feeding position) in casing 2 is moved outward of the casing 2 in the direction indicated by the arrow mark Z in FIGS. 5-8, the bottom guide 63 is pivotally moved by the bottom guide moving means so that its front end portion (upstream portion in terms of recording medium conveyance direction) moves into the storing portion 31*i*, which is the inward adjacencies of the rear plate 31*i* of the feeding-conveying cassette 31.

This bottom guide moving means has the pair of regulation rollers 66 which function as regulating members. Referring to FIG. 5, the image forming apparatus 1 is structured so that each regulation roller 66 is allowed to rotate on the corresponding horizontal guiding surface 31*c*, shown in FIG. 5, and slant guiding surface 31*d*, shown in FIGS. 7 and 8, between the front end of horizontal guiding surface 31*c* (regulatory position) and the rear end of the slant guiding surface 31*d* (nonregulatory position). The horizontal guiding surface 31*c* shown in FIG. 5 (regulatory surface) prevents the bottom guide 63 from pivotally moving (changing in attitude), whereas the slant guiding surface 31*d* (nonregulatory surface) shown in FIGS. 7 and 8 allows the bottom guide 63 to pivotally move (change in attitude).

The pair of regulation rollers 66 are rotatably supported by a pair of supporting shafts 63*a*, one for one, attached to the edge portions of the bottom guide 63 in terms of the widthwise direction of the bottom guide 63. Thus, as the bottom guide 63 pivotally moves in the direction indicated by the arrow mark R1 in FIGS. 7 and 8 about the rotational shaft 61*c* of the registration roller 61*a*, the pair of regulation rollers 66 move with the bottom guide 63.

As the feeding-conveying cassette 31 (cassette) in the casing 2 is drawn by a user in the direction indicated by the arrow mark Z in FIGS. 5-8, each of the pair of regulation rollers 66 rotates on the horizontal guiding surface 31*c* of the corresponding lateral plate 31*g* of the feeding-conveying cassette 31, and then, on the slant guiding surface 31*d* of the corresponding lateral plate 31*g*; it moves relative to the horizontal guiding surface 31*c* and slant guiding surface 31*d*.

On the other hand, as the feeding-conveying cassette 31 (cassette) is inserted into the casing 2 in the opposite direction from the direction indicated by the arrow mark Z in FIGS. 5-8, each of the pair of regulation rollers 66 rotates on the slant guiding surface 31*d* of the corresponding lateral plate 31*g*, which is a part of the upwardly facing surface of the lateral plate 31*g*, and then, on the horizontal guiding surface 31*c* of the corresponding lateral plate 31*g*, which is the other part of the upwardly facing surface of the lateral plate 31*g*; it moves relative to the upwardly facing surface of the lateral plate 31*g*.

As each of the pair of regulation rollers 66 rotates on the horizontal guiding surface 31*c* or slant guiding surface 31*d*, the bottom guide 63 remains pressed upon the horizontal guiding surface 31*c* or slant guiding surface 31*d*, respectively, by its own weight.

Referring to FIG. 8, as the feeding-conveying cassette 31 (cassette) in the casing 2 is drawn by a user in the direction indicated by the arrow mark Z in FIG. 8, each regulation roller 66 (regulatory member) moves into its retraction position (nonregulatory position) on the slant guiding surface 31*d*. That is, the bottom guide 63 pivotally moves in such a manner that its rear portion moves into the storing portion 31*j* in the inward adjacencies of the rear plate 31*i* of the feeding-conveying cassette 31.

As the rear portion of the bottom guide 63 moves into the storing portion 31*j* in the inward adjacencies of the rear plate 31*i*, the bottom guide 63 is caught by its bottom surface by the engaging portion 62*a*1, that is, the bottom end portion, of each of the pair of protrusive portions 62*a* which protrude downward from the lateral edges of the top guide 62, and which is shaped like a letter "J" in cross-section. Thus, the bottom guide 63 is held in its retraction position, shown in FIG. 8, by its own weight.

On the other hand, as the feeding-conveying cassette 31 is inserted into the main assembly of the image forming apparatus 1 in the opposite direction from the direction indicated by the arrow mark Z in FIG. 8, each of the pair of regulation rollers 66 rotates in contact with the slant guiding surface 31*d* as it rolls on the slant guiding surface 31*d*, causing, thereby, the bottom guide 63 to pivotally move in the opposite direction from the direction indicated by the arrow mark R1 in FIGS. 7 and 8 about the rotational shaft 61*c* of the registration roller 61*a*. Then, as the border line 31*h*, shown in FIG. 6, moves past the regulation roller 66, the regulation roller 66 rotates in contact with the horizontal guiding surface 31*c* as it rolls on the horizontal guiding surface 31*c*. Thus, the bottom guide 63 is held in its regulatory position (normal position) shown in FIG. 5. By the way, regarding the choice of the regulating members with which the bottom guide 63 is provided, various members can be employed as long as they allow the horizontal guiding surface 31*c* and slant guiding surface 31*d* to slide in contact with them.

The feeding-conveying cassette 31 stores multiple sheets 7 of recording medium so that the sheets 7 are loaded in layers on the mid plate 8 in the cassette 31. The sheets 7 are fed rightward one by one into the main assembly of the image forming apparatus 1 while being separated by the coordination between the feeding-conveying roller 30, which rotates in the counterclockwise direction of FIG. 1, and the separation pad 31*b*2. As each sheet 7 is fed into the main assembly, it is guided by the top guide 64*a* of the front guide 64, so that it U-turns to be conveyed leftward in FIG. 1. Meanwhile, the sheet 7 is supported by its bottom surface, by the bottom guide 63 held in its regulatory position shown in FIG. 5, in such a manner that it is allowed to slide on the bottom guide 63. Thus, the sheet 7 is conveyed past the pair of conveyance rollers 60, and then, to the pair of registration rollers 61.

The bottom guide 63 has a bent portion 63*b* which changes each sheet 7 of recording medium in conveyance direction so that the sheet 7 begins to be conveyed in the opposite direction from the direction in which the sheet 7 is fed into the main assembly, as the sheets 7 are fed one by one into the main assembly of the image forming apparatus 1 by the coordination of the feeding-conveying roller 30 and separation pad 31*b*2, from the feeding-conveying cassette 31 (cassette).

Figure 6:
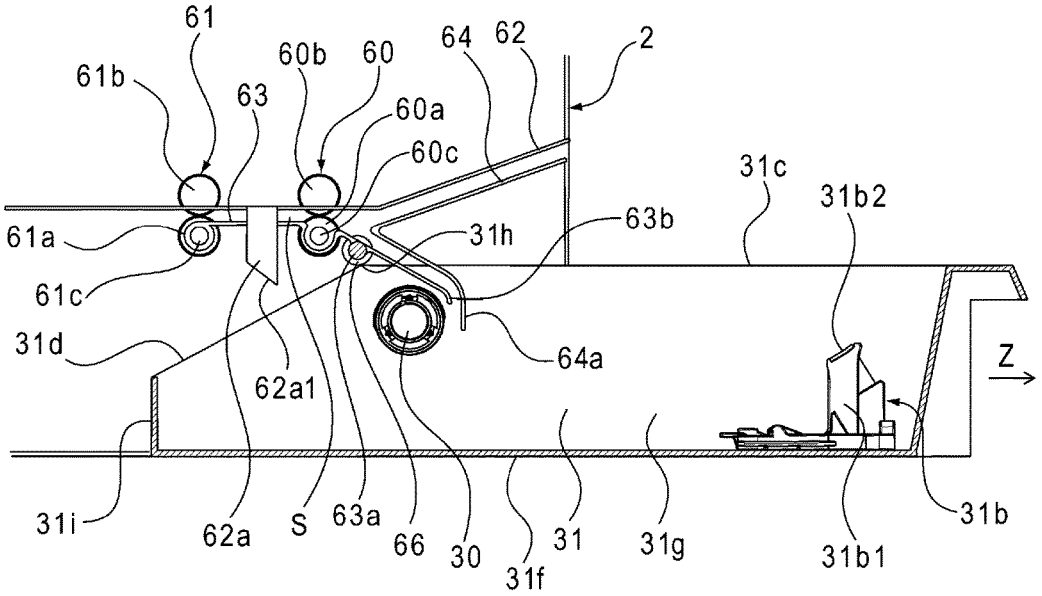
FIG. 6 is a sectional view of the combination of the recording medium feeding-conveying cassette and recording medium feeding-conveying portion, in the first embodiment, at the vertical plane A-A in FIG. 4, when the bottom guide is about to be rotationally moved (retracted) from its normal position (recording medium guiding position) into its retraction position.

The bottom guide 63 pivotally moves about the rotational shaft 61*a* of the registration roller 61*a*, shown in FIGS. 6 and 7, between its retraction position, shown in FIG. 5, and its normal position (non-retraction position) shown in FIG. 8. Thus, in order to prevent the bottom guide 63 from colliding with the feeding-conveying roller 30 and the rotational shaft 32 of the feeding-conveying roller 30 during the pivotal movement of the bottom guide 63, the bottom guide 63 is provided with a recess 63*c* shown in FIG. 3.

<Action of Bottom Guide Moving Means>

Next, referring to FIGS. 4-8, the action of the means for moving the bottom guide 63 is described. FIG. 4 is a top view of a combination of the conveying portion 6 and feeding-conveying cassette 31 when the bottom guide 63 is in its normal position (sheet guiding position) shown in FIG. 5. It is for describing the structure of the means for moving the bottom guide 63. FIG. 5 is a sectional view of the combination at a plane A-A in FIG. 4. Referring to FIG. 5, when the feeding-conveying cassette 31 is in its preset position (sheet feeding position) in the main assembly of the image forming apparatus 1, the bottom guide 63 is held in normal position (sheet guiding position), and each of the pair of regulation rollers 66 rotatably supported by the corresponding lengthwise end portion of the supporting shaft 63*a* with which the bottom guide 63 is provided, is in contact with the horizontal guiding surface 31*c*, that is, a part of the upwardly facing surface, of the corresponding lateral plate 31*g*, being therefore held in its normal position (sheet guiding position) shown in FIG. 5.

FIG. 6 is a sectional view of a combination of the conveying portion 6 and feeding-conveying cassette 31 at the plane A-A in FIG. 4. It is for showing the structure of the means for moving the bottom guide 63 when the feeding-conveying cassette 31 in the casing 2 of the main assembly of the image forming apparatus 1 begins to be drawn outward in the direction indicated by the arrow mark Z in FIG. 6, and therefore, the bottom guide 63 begins to pivotally move from the normal position (sheet guiding position) shown in FIG. 5 to its retraction position shown in FIG. 8.

Referring to FIG. 6, as the feeding-conveying cassette 31 in the casing 2 of the main assembly of the image forming apparatus 1 is drawn by a preset amount by a user in the direction indicated by the arrow mark Z in FIG. 6, the border line 31*h* between the horizontal guiding surface 31*c* and slant guiding surface 31*d* reaches the corresponding regulation roller 66, which was rotating in contact with the horizontal guiding surface 31*c*, that is, a part of the upwardly facing surface, of the corresponding lateral plate 31*g* with which the feeding-conveying cassette 31 is provided.

FIG. 7 is a sectional view of the combination of the conveying portion 6 and feeding-conveying cassette 31 at the plane A-A in FIG. 4 after the feeding-conveying cassette 31 which was in the state shown in FIG. 6 was drawn further outward relative to the casing 2 of the main assembly of the image forming apparatus 1 in the direction indicated by the arrow mark Z in FIG. 7. It is for showing the structure of the means for moving the bottom guide 63. As the feeding-conveying cassette 31 is drawn outward relative to the casing 2 of the main assembly of the image forming apparatus 1 in the direction indicated by the arrow mark Z in FIG. 7, the slant guiding surface 31*d*, which is a part of the upwardly facing surface of one of the pair of lateral plates 31*g* with which the feeding-conveying cassette 31 is provided comes into contact with the corresponding regulation roller 66.

Thus, the bottom guide 63 is made by its own weight to pivotally move in the direction indicated by the arrow mark R1 in FIG. 7 about the rotational shaft 61*c* of the registration roller 61*a*. Since the bottom guide 63 is provided with the escape 63*c*, shown in FIG. 3, it does not occur that, as the bottom guide 63 pivotally moves in the abovementioned direction, it collides with the feeding-conveying roller 30 and the rotational shaft 32 of the feeding-conveying roller 30.

FIG. 8 is a sectional view of the combination of the conveying portion 6 and feeding-conveying cassette 31 at the plane A-A in FIG. 4 after the feeding-conveying cassette 31 was drawn relative to the casing 2 of the main assembly of the image forming apparatus 1 in the direction indicated by the arrow mark Z in FIG. 8 far enough for the bottom guide 63, which was in the state shown in FIG. 7, to pivotally move into its retraction position. It is for showing the structure of the means for moving the bottom guide 63. Referring to FIG. 8, as the feeding-conveying cassette 31 in the casing 2 of the main assembly of the image forming apparatus 1 is drawn by a user in the direction indicated by the arrow mark Z in FIG. 8 relative to the casing 2, the bottom guide 63 is made by its own weight to pivotally move in the direction indicated by the arrow mark R1 in FIG. 8 about the rotational shaft 61*c* of the registration roller 61*a*.

As the bottom guide 63 pivotally moves as described above, it comes into contact with the bottom guide engaging portions 62*a*1, which is the bottom portion of each of the pair of protrusive portions 62*a* which protrude downward from the lateral edges of the top guide 62, and which is shaped like a letter "J" in cross-section. The contact completes the pivotal moving of the bottom guide 63 into the retraction position shown in FIG. 8. Thereafter, the feeding-conveying cassette 31 can be drawn out of the main assembly of the image forming apparatus 1 without colliding with the bottom guide 63, which is in its retraction position shown in FIG. 8, because the rear plate 31*i* of the feeding-conveying cassette 31 is provided with the escape 31*e* (recess, opening).

In this embodiment, as the feeding-conveying cassette 31 in the main assembly of the image forming apparatus 1 is drawn outward by a user, the bottom guide 63 pivotally moves into the its retract position shown in FIG. 8. That is, the bottom guide which includes the bend portion 63*b*, which is a part of the sheet conveyance passage S, retracts in a manner to expose the recording medium conveyance passage S.

As the feeding-conveying cassette 31 in the casing 2 of the main assembly of the image forming apparatus 1 is drawn outward of the casing 2 by a user, the bottom guide 63 provided with the bend portion 63*b* which is a part of the recording medium conveyance passage S, through which a sheet 7 fed into the main assembly is conveyed, moves into the storing portion 31*j* which is in the inward adjacencies of the rear plate 31*i* of the feeding-conveying cassette 31, making it easier for the user to access the recording medium conveyance passage S from the underside of the passage S, in order to remove a sheet 7 of recording medium jammed at the bend portion 63*b* of the passage S, at which the sheet 7 fed from the feeding-conveying cassette 31 into the main assembly is made to U-turn to be conveyed leftward in FIG. 1.

In this embodiment, the casing 2 is provided with the slit 2*a* (opening). Further, the top guide 64*a* of the front guide 64, and the bottom guide 67 are provided with slits 64*b* and 67*a*, respectively. Further, the image forming apparatus 1 is structured so that the slits 2*a*, 64*b*, and 67*a* align in the direction indicated by an arrow mark X in FIG. 8.

Therefore, the ambient light in the adjacencies of the main assembly of the image forming apparatus 1 is allowed to enter the conveyance passage S in the direction indicated by the arrow mark X in FIG. 8. Thus, when a user has to remove a jammed sheet 7 of recording medium in the conveyance passage S, the interior of the conveyance passage S is lit, making it easier for the user to see the inside of the conveyance passage S, through which the sheet 7 is conveyed, and therefore, easier for the user to remove the jammed sheet 7 in the conveyance passage S.

[Embodiment 2]

Next, referring to FIGS. 9-14, the structure of the image forming apparatus in the second embodiment of the present invention is described. By the way, the members of the image forming apparatus in this embodiment, and the portions thereof, which are similar in structure as the counterparts in the first embodiment, are given the same reference numerals as the counterparts and are not described. Further, even if a different reference numeral is used for given member of the image forming apparatus in this embodiment that is from the counterpart in the first embodiment, the member is not described as long as a similar name is used for the counterpart.

<Means for Rotationally Moving Bottom Guide>

Figure 9:
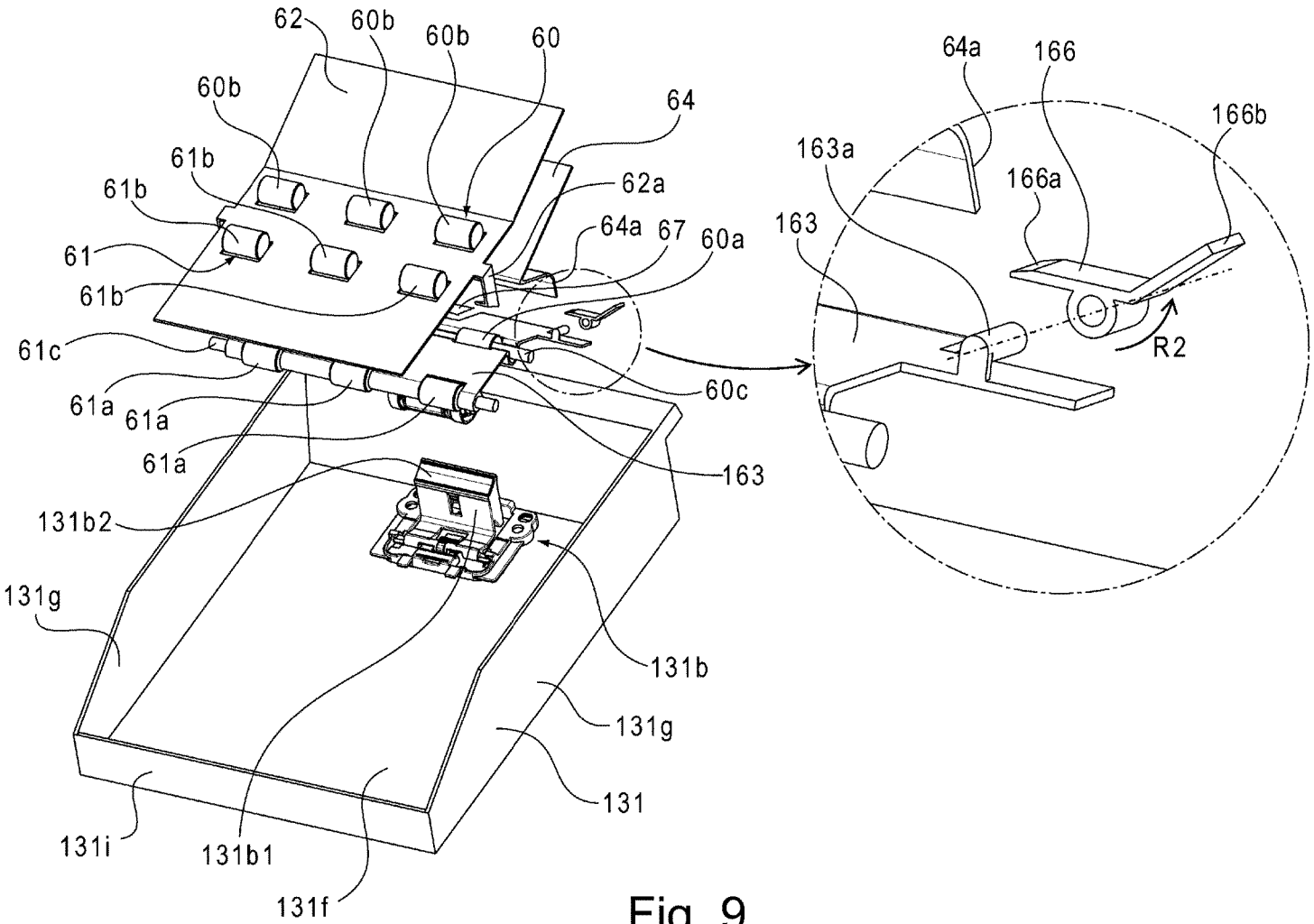
FIG. 9 is an exploded perspective of a combination of the recording medium feeding-conveying cassette and recording medium feeding-conveying portion of the image forming apparatus in the second embodiment of the present invention, as seen from the top side of the recording medium feeding-conveying portion, when the recording medium feeding-conveying cassette is in its preset position (recording medium feeding position) in the casing of the apparatus. It shows the structure of the means for rotationally moving the bottom guide of the recording medium conveyance passage of the apparatus.

First, referring to FIG. 9, the structure of the means for rotationally moving the bottom guide 163 in this embodiment is described. FIG. 9 is an exploded perspective view of a combination of the conveying portion 6 and feeding-conveying cassette 131 in this embodiment, as seen from the top side of the combination. It is for showing the structure of the means for rotationally moving the bottom guide 163. Referring to FIG. 9, the bottom guide 163, which is one of the conveyance guides in this embodiment is provided with a supporting shaft 163*a*, which the supporting shaft of 163*a* rotatably supports a regulating plate 166, which is a regulating member. The regulating plate 166 is always under the pressure generated in the direction indicated by an arrow mark R2 in FIG. 9 by an unshown spring which functions as pressure generating means. In this embodiment, it is the regulating plate 166 that controls the operation for switching the bottom guide 163 in position.

Figure 12:
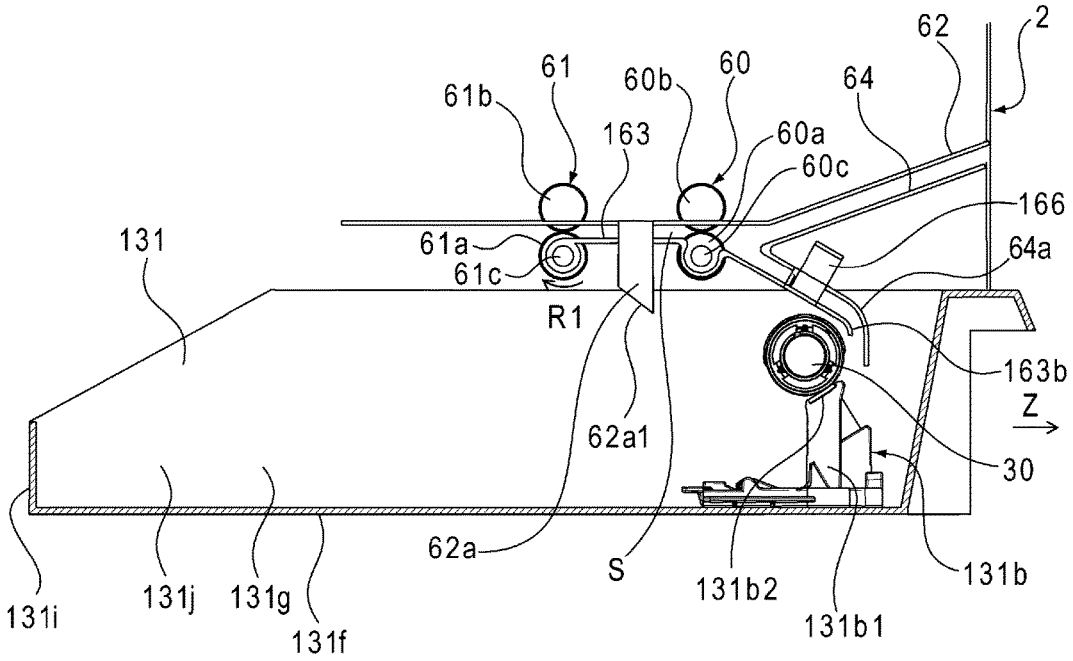
FIG. 12 is a sectional view of the combination of the recording medium feeding-conveying cassette and recording medium feeding-conveying portion in the second embodiment, at a vertical plane B-B in FIG. 11, when the bottom guide is in its normal position (recording medium guiding position).
Figure 13:
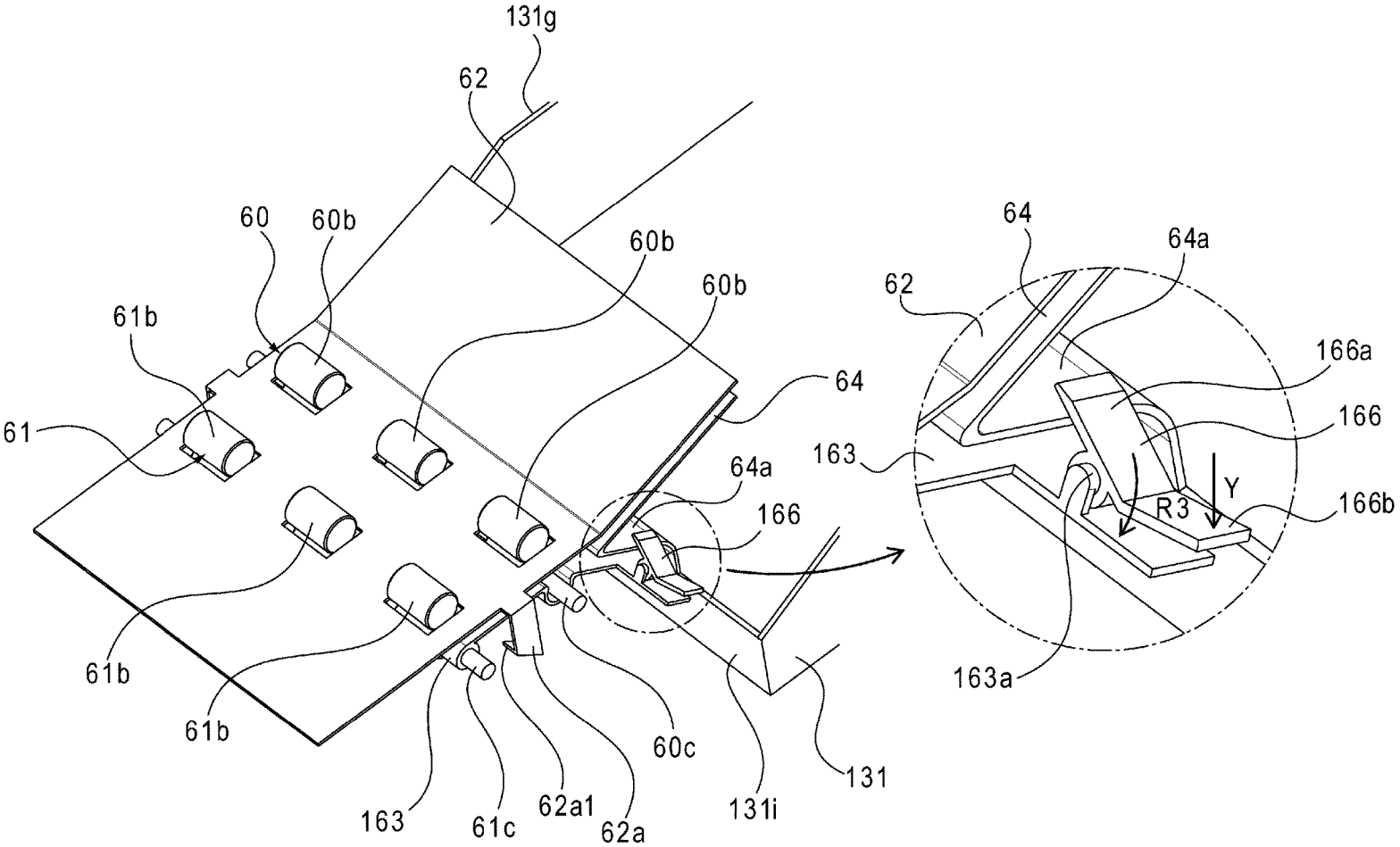
FIG. 13 is a perspective view of the bottom guide moving means, as seen from the top side of the means, when the bottom guide is ready to be rotationally moved from its recording medium feeding-conveying position to its retraction position.

In this embodiment, first, a user is to draw the feeding-conveying cassette 131 in the casing 2 in the direction indicated by an arrow mark Z in FIG. 12 by a certain distance, and then, to press the tab portion 166*b* of the regulating plate 166 in the direction indicated by an arrow mark Y in FIG. 13 against the resiliency of the aforementioned spring. As the tab portion 166*b* is pressed, the regulating plate 166 pivotally moves in the direction indicated by an arrow mark R3 in FIG. 13 about the supporting shaft 163*a*. Consequently, the engaging portion 166*a* of the regulating plate 166 retracts from the top guide 64*a* of the front guide 64, allowing thereby the bottom guide 63 to be made by its own weight to pivotally move in the direction indicated by an arrow mark R2 in FIG. 12 about the rotational shaft 61*c* of the registration roller 61. As a result, the bottom guide 63 changes in attitude in such a manner that its bottom portion moves into the storing portion 131*j* which is in the inward adjacencies of the rear plate 131*i* of the feeding-conveying cassette 131.

Figure 10:
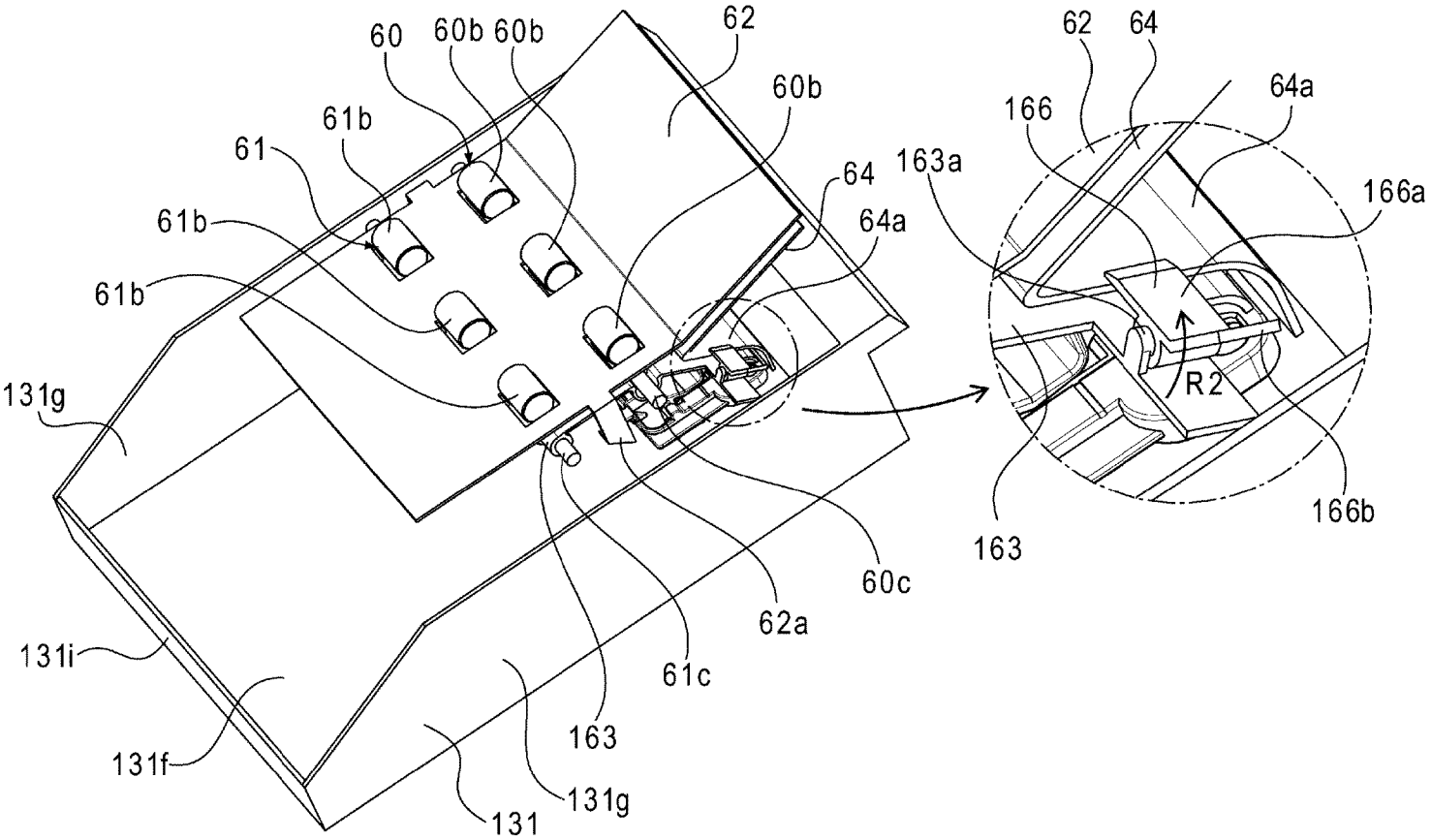
FIG. 10 is an exploded perspective of the combination of the recording medium feeding-conveying cassette and recording medium feeding-conveying portion of the image forming apparatus in the second embodiment of the present invention, as seen from the top side of the recording medium feeding-conveying portion, when the recording medium feeding-conveying cassette is in its preset position (recording medium feeding position) in the casing of the apparatus. It shows the structure of the means for rotationally moving the bottom guide of the recording medium conveyance passage of the apparatus.

In this embodiment, the means for rotationally moving the bottom guide 163 has the regulating plate 166, as a regulating member, which can be changed in attitude between the regulatory one, shown in FIG. 10, in which it prevents the bottom guide 163 from rotationally moving, and the non-regulatory one, shown in FIG. 13, in which it allows the bottom guide 163 to pivotally move. When the regulating plate 166 is in the regulatory position shown in FIG. 10, it always remains pressed in the direction indicated by an arrow mark R2 in FIG. 9 by the unshown spring. Thus, the engaging portion 166*a* of the regulating plate 166 remains in contact with the top guide 64*a* of the front guide 64. Therefore, the bottom guide 163 is kept stationary against its own weight.

As a user presses the tab portion 166*b* of the regulating plate 166 in the direction indicated by an arrow mark Y in FIG. 13 against the resiliency of the unshown spring, the regulating plate 166 pivotally moves into the release position shown in FIG. 13. Thus, its engaging portion 166*a* retracts away from the top guide 64*a* of the front guide 64 disengaging the front guide 64 from the bottom guide 163. Consequently, the bottom guide 63 is made by its own weight to pivotally move in the direction indicated by the arrow mark R1 in FIG. 12 about the rotational shaft 61*c* of the registration roller 61*a*.

The user is to draw the feeding-conveying cassette 131 (cassette) in the casing 2 in the direction indicated by an arrow mark Z in FIG. 12. In order for the user to draw the feeding-conveying cassette 131, the user is to pivotally move the regulating plate 166 (preventing member) into the release position shown in FIG. 13, so that the bottom guide 163 is allowed to be made by its own weight to pivotally move in the direction indicated by an arrow mark R1 in FIG. 12 about the rotational shaft 61*c* of the registration roller 61*a*, in such a manner that the front end portion of the bottom guide 163 moves into the storing portion 131*j* which is in the inward adjacencies of the rear plate 131*i* of the feeding-conveying cassette 131 (cassette).

The bottom guide 163 (conveyance guide) has a bent portion 163*b* which roughly reverses a sheet 7 of recording medium in conveyance direction, in coordination with the top guide 64*a* of the front guide 64, as soon as the sheet 7 is fed into the main assembly of the image forming apparatus 1 from the feeding-conveying cassette 131. Further, the casing 2 and the top and bottom guides 64*a* and 67 of the front guide 64, which make up the conveyance guide in this embodiment, are provided with slits 2*a*, 64*b* and 67*a*, respectively, like the counterparts in the first embodiment described previously with reference to FIG. 8. Thus, ambient light is allowed to enter the main assembly of the image forming apparatus 1 in the direction indicated by the arrow mark X in FIG. 8, through the slits 2*a*, 64*b*, and 67*a*, making it easier for a user to see the inside of the conveyance passage S (conveyance passage interior) through which the sheet 7 is conveyed.

<Action of Means for Rotationally Moving Bottom Guide>

Figure 11:
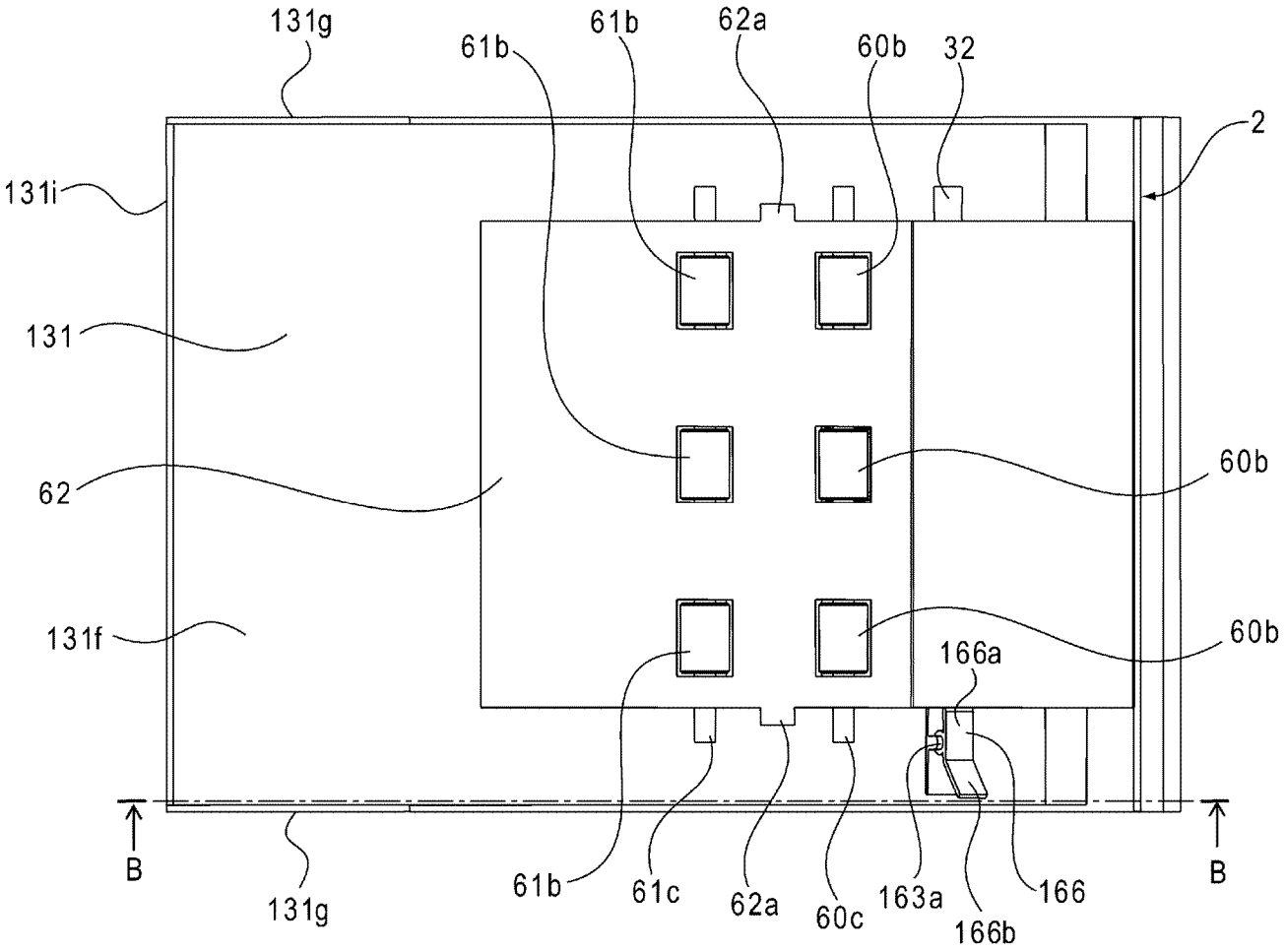
FIG. 11 is a top view of the combination of the recording medium feeding-conveying cassette and recording medium feeding-conveying portion in the second embodiment, when the bottom guide is in its normal position (recording medium guiding position). It shows the structure of the bottom guide moving means.

Next, referring to FIGS. 10-14, the action of the means, in this embodiment, for causing the bottom guide 163 to rotationally move is described. FIG. 10 is an exploded perspective view of a combination of the conveying portion 6 and feeding-conveying cassette 131 in this embodiment, as seen from the top side of the combination, when the bottom guide 163 is in its normal position. It is for showing the structure of the means for causing the bottom guide 163 to pivotally move. FIG. 11 is a top view of the combination of the conveying portion 6 and feeding-conveying cassette 131 when the bottom guide 163, shown in FIG. 10, is in its retraction position. It is for showing the structure of the means. FIG. 12 is a sectional view of the combination, at a plane B-B in FIG. 11, when the bottom guide 163 is in the normal position. It is for showing the means for causing the bottom guide 163 to pivotally move.

Referring to FIG. 10, the regulating plate 166 is kept pressed in the direction indicated by an arrow mark R2 in FIG. 10 by an unshown spring. Thus, an engaging portion 166*a* of the regulating plate 166, which is one of the lengthwise end portion of the regulating plate 166, remains in contact with the top surface of the top guide 64*a* of the front guide 64, in such a manner that it presses on the front guide 64. Thus, the bottom guide 163, which is supported by the rotational shaft 61*c* of the registration roller 61*a* so that it is allowed to pivotally move about the rotational shaft 61*c*, is prevented from being made by its own weight to pivotally move in the direction indicated by the arrow mark R1 in FIG. 12. Therefore, the bottom guide 163 is held in its normal position show in FIG. 12.

Figure 14:
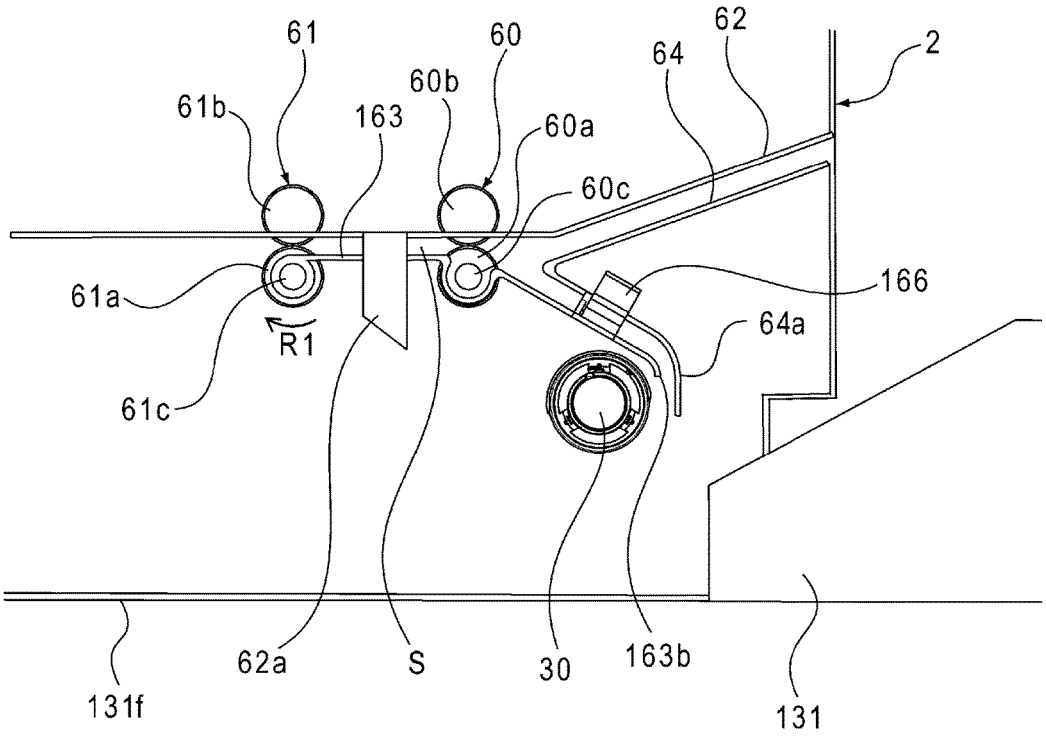
FIG. 14 is a sectional view of the recording medium feeding-conveying portion in the second embodiment, at the vertical plane B-B in FIG. 11, when the bottom guide is about to rotationally retract from its normal position (recording medium guiding position).

FIG. 13 is a perspective view of a combination of the conveying portion 6 and regulating plate 166, as seen from the top side of the combination, when the bottom guide 163 is ready to pivotally move from its normal position, shown in FIG. 12, to its retraction position, like the bottom guide 63 in the first embodiment described above with reference to FIG. 8. It is for describing the structure of the means for causing the bottom guide 163 to pivotally move. FIG. 14 is a sectional view of the combination at a plane B-B in FIG. 11 when the bottom guide 163 shown in FIG. 13 has just been enabled to pivotally move from its normal position to its retraction position. It is for showing the structure of the means.

Referring to FIG. 13, if it is necessary for a user to remove a sheet 7 of recording medium jammed in the conveyance passage S, the user is to draw the feeding-conveying cassette 131 in the main assembly of the image forming apparatus 1 in the direction indicated by the arrow mark Z in FIG. 12. First, the user is to press the tab portion 166*b* of the regulating plate 166 in the direction indicated by the arrow mark Y in FIG. 13 against the resiliency of the unshown spring. As the tab portion 166*b* is pressed, the regulating plate 166 pivotally moves in the direction indicated by the arrow mark R3 in FIG. 13 about the supporting shaft 163*a*. Thus, the bottom guide 163 is freed from the engaging portion 166*a* of the regulating plate 166. As a result, the bottom guide 163 is made by its own weight to pivotally move in the direction indicated by an arrow mark R4 about the rotational shaft 61*c* of the registration roller 61*a* shown in FIG. 14, to retract into its retraction position like the bottom guide 63 in the first embodiment described above with reference to FIG. 8.

Then, the bottom guide 163 is caught by the engaging portion 62*a*1, which is the front portion of each of the pair of protrusive portions which protrude downward from the edges of the top guide 62, one for one, in terms of the widthwise direction of the top guide 62, and which is J-shaped in cross section. This ends the pivotal movement of the bottom guide 163 into its retraction position.

Also in this embodiment, a user is to draw the feeding-conveying cassette 131 in the casing 2 of the main assembly of the image forming apparatus 1 in the direction indicated by the arrow mark Z in FIG. 12. Then, the user is to press the tab portion 166*b* of the regulating plate 166 to free the bottom guide 163 from the engaging portion 166*a*. As the tab portion 16*b* is pressed, the bottom guide 163 is made by its own weight to pivotally move into its retraction position like the bottom guide 63 in the first embodiment described above with reference to FIG. 8. That is, the bottom guide 163 which includes the bent portion 163*b* (which corresponds to bend portion of the conveyance passage S shown in FIG. 14), retracts in a manner to expose the conveyance passage S.

Next, a user is to draw the feeding-conveying cassette 131 in the casing 2 of the main assembly of the image forming apparatus 1 in the direction indicated by the arrow Z in FIG. 8. Since the image forming apparatus 1 is structured so that as the feeding-conveying cassette 131 in the main assembly is drawn in the above-described direction, the front portion of the bottom guide 163 having the bent portion 163*b* which is a part of the conveyance passage S through which a sheet 7 of recording medium is conveyed after being fed into the main assembly, moves into the storing portion 131*j* which is in the inward adjacencies of the rear plate 131*i*, making it easier for a user to access the conveyance passage S from the under side of the conveyance passage S. That is, this embodiment makes it easier for a user to remove a sheet 7 of recording medium having jammed in the portion of the conveyance passage S, which corresponds in position to where the sheet 7 is U-turned leftward in FIG. 1 after being fed rightward of FIG. 1 into the main assembly from the feeding-conveying cassette 131.

By the way, the separating portion 131*b*, separation pad holder 131*b*1, separation pad 131*b*2, bottom plate 131*g*, and rear plate 131*i*, which are shown in FIGS. 9-14 correspond to separating portion 31*b*, separation pad holder 31*b*1, separation pad 31*b*2, bottom plate 31*f*, lateral plates 31*g*, and rear plate 31*b* in the first embodiment described above. Each of these members is the same in structure and effect as the counterparts in the first embodiment, and therefore, is not described here in order not to repeat the same descriptions. Other structural components in this embodiment are also similar in structure to the counterparts in the first embodiment, and can offer the similar effects as the counter parts.

[Embodiment 3]

Next, referring to FIGS. 15-18, the image forming apparatus 1 in the third embodiment of the present invention is described about its structure. By the way, the members of the image forming apparatus 1 in this embodiment, and the portions thereof, which are similar in structure to the counterparts in each of the preceding embodiments, are given the same reference numerals as the counterparts and are not described. Further, in a case where a given member of the image forming apparatus 1 in this embodiment is different in reference numerals from the counterpart in each of the preceding embodiments, but, is similar in structure to the counterpart, it is not described.

<Means for Rotationally Moving Bottom Guide>

Figure 15:
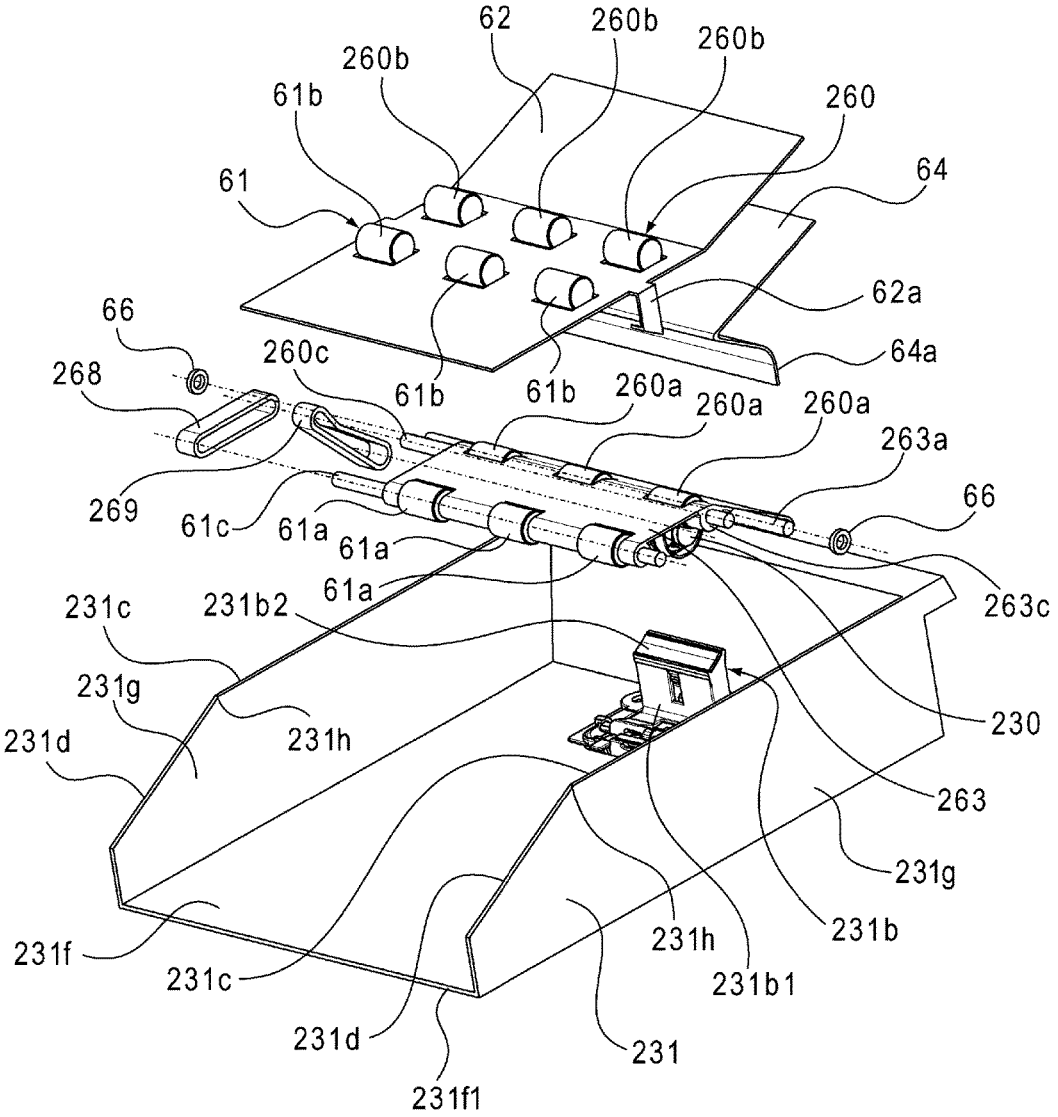
FIG. 15 is an exploded perspective view of a combination of the recording medium feeding-conveying cassette and recording medium feeding-conveying portion in the third embodiment of the present invention, as seen from the top side of the recording medium feeding-conveying portion, when the cassette is in its preset position (recording medium feeding position) in the main assembly of an image forming apparatus. It shows the structure of the bottom guide moving means.
Figure 16:
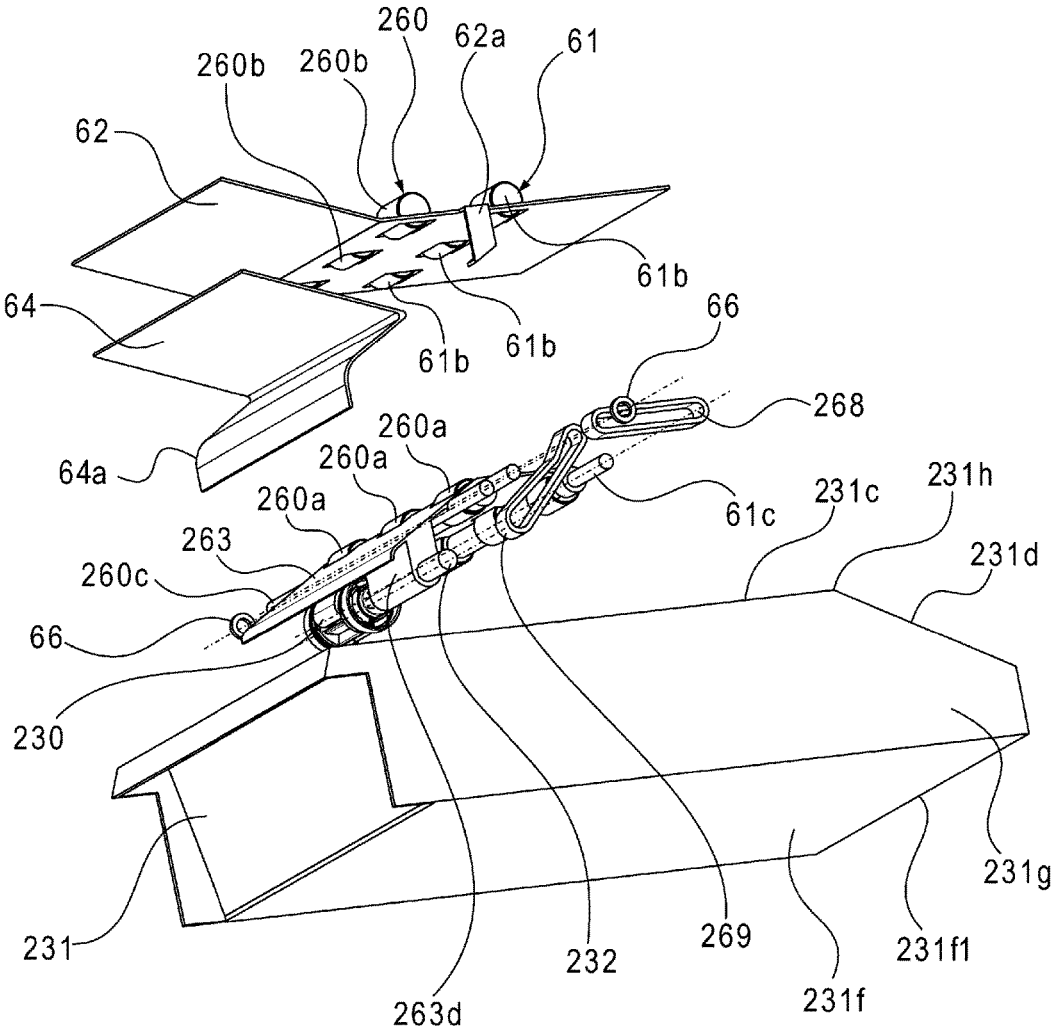
FIG. 16 is an exploded perspective view of the combination of the recording medium feeding-conveying cassette and recording medium feeding-conveying portion in the third embodiment of the present invention, as seen from the bottom side of the cassette, when the cassette is in its preset position (recording medium feeding position) in the main assembly of an image forming apparatus. It shows the structure of the bottom guide moving means.
Figure 17:
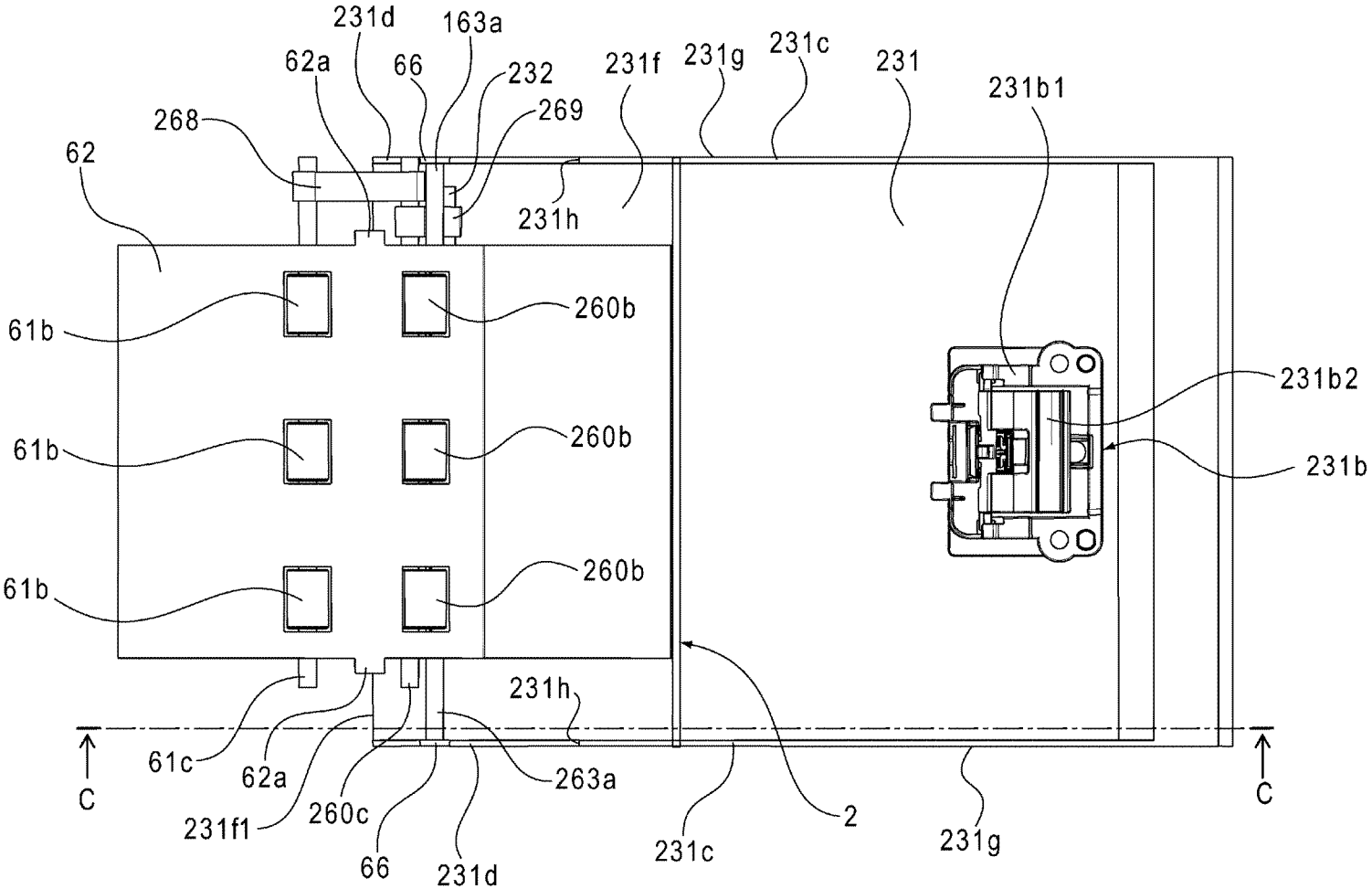
FIG. 17 is a top view of the combination of the recording medium feeding-conveying cassette and recording medium feeding-conveying portion in the third embodiment, when the bottom guide is in its retreat. It shows the structure of the bottom guide moving means.
Figure 18:
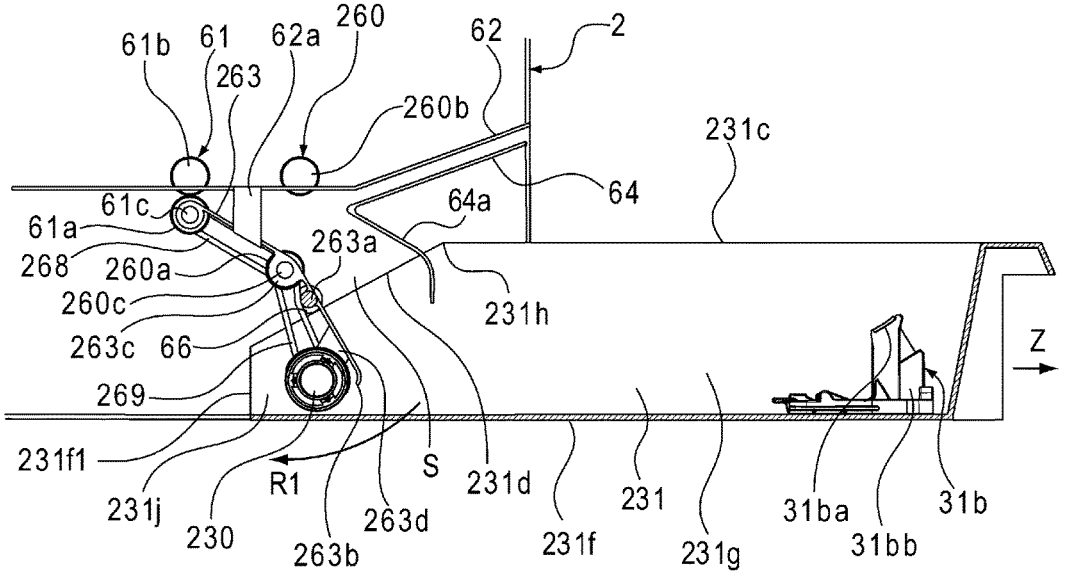
FIG. 18 is a sectional view of the combination of the recording medium feeding-conveying portion and recording medium feeding-conveying cassette of the image forming apparatus in the third embodiment, at a plane C-C in FIG. 17, when the bottom guide is in its retreat.

First, referring to FIGS. 15 and 16, the structure of the means, in this embodiment, for causing the bottom guide 263 to pivotally move is described. FIG. 15 is an exploded perspective view of a combination of a conveying portion 6 and a feeding-conveying cassette 231 in this embodiment, as seen from the top side of the combination, when the feeding-conveying cassette 231 is in its preset position (sheet feeding position) in the casing 2 of the main assembly of the image forming apparatus 1. It is for showing the structure of the means for causing the bottom guide 63 to pivotally move. FIG. 16 is an exploded perspective view of the combination of the conveying portion 6 and feeding-conveying cassette 231 in this embodiment, as seen from the bottom side of the combination, when the feeding-conveying cassette 31 is in its preset position (sheet feeding position) in the casing 2. It is for showing the structure of the means for causing the bottom guide 63 to pivotally move. FIG. 17 a top view of the combination when the bottom guide 263 is in its retraction position. It is for describing the structure of the means for causing the bottom guide 263 to pivotally move. FIG. 18 is a sectional view of the combination, at a plane C-C in FIG. 17, when the bottom guide 263 is in its retraction position.

In this embodiment, the rotational force of an unshown motor, as a driving force source, is transmitted to the rotational shaft 260*c* of the conveyance roller 260*a* by way of the rotational shaft 61*c* of the registration roller 61*a* and a driving belt 268. Further, the rotational driving force transmitted to the rotational shaft 260*c* is transmitted to the rotational shaft 232 of the feeding-conveying roller 230 by way of the driving belt 269.

Referring to FIG. 17, in terms of the widthwise direction of a sheet 7 of recording medium, the driving belt 268 is disposed on the outward side of the driving belt 269; the driving belt 269 is disposed on the inward side of the driving belt 268. The rotational driving force transmitted to the rotational shaft 61*c* of the registration roller 61*a* is transmitted to the rotational shaft 260*c* of the conveyance roller 260*a* by way of the driving belt 268. Further, the rotational driving force transmitted to the rotational shaft 260*c* is transmitted to the rotational shaft 232 of the feeding-conveying roller 230, shown in FIG. 16, by way of the driving belt 269. Thus, the registration roller 61*a*, conveyance roller 260*a*, and feeding-conveying roller 230 rotate together.

Also in this embodiment, in a case where it is necessary for the feeding-conveying cassette 231 (cassette) to be moved out of the casing 2, it is to be drawn by a user in the direction indicated by an arrow mark Z in FIG. 18 as the feeding-conveying cassette 231 is drawn by a user in the direction indicated by the arrow mark Z in a similar manner as described in the first embodiment above. As the feeding-conveying cassette 231 is drawn, the bottom guide 263 is made to pivotally move in the direction indicated by an arrow mark R1 in FIG. 18 about the rotational shaft 61*c* of the registration roller 61*a* by the combination of the means for causing the bottom guide 263 to pivotally move and the weight of the bottom guide 263 the bottom guide moves in such a manner that the front portion of the bottom guide 263 moves into the storing portion 231*j* which is in the inward adjacencies of the rear portion 231*f*1 of the feeding-conveying cassette 231 (cassette interior).

Also the means for rotationally moving the bottom guide 263 in this embodiment is a pair of regulating rollers 66, which are regulating members. The pair of regulating rollers 66 are rotatably supported by a pair of supporting shafts 263*a*. The pair of supporting shafts 263*a* are provided, one for one, on the edge portions of the bottom guide 263 in terms of its widthwise direction like the pair of regulating rollers 66 are rotatably supported by the pair of supporting shafts 63*a* in the first embodiment. Further, the horizontal guiding surface 231*c*, which is a part of the upwardly facing surface of each of the pair of lateral plates 231*g* of the feeding-conveying cassette 231 moves into a position in which it prevents the bottom guide 263 from rotationally moving. Further, the slant guiding surface 231*d*, which is another part of the upwardly facing surface of each of the pair of side plates 231*g* of the feeding-conveying cassette 231 allows the bottom guide 263 to rotationally move.

The image forming apparatus 1 is structured so that, as the feeding-conveying cassette 231 (cassette) in the casing 2 is drawn by a user in the direction indicated by the arrow mark Z in FIG. 18 or the feeding-conveying cassette 231 is inserted into the casing 2 by the user in the opposite direction from the direction indicated by the arrow mark Z in FIG. 18, the pair of regulating rollers 66 (preventing members) rotate on the horizontal guiding surface 231*c* (preventing position) and then on the slant guiding surface 231*d* as they are running on the surfaces 231*c* or 231*d* in the direction indicated by the arrow mark Z in FIG. 18, or rotate on the slant guiding surface 231 (releasing position) and horizontal guiding surface 231*c* as they are running on the surfaces 231*d* or 231*c* in the opposite direction from the direction indicated by the arrow mark Z in FIG. 18.

Thus, as the feeding-conveying cassette 231 (cassette) in its preset position (sheet feeding position) in casing 2 is drawn by a user in the direction indicated by the arrow mark Z in FIG. 18, the regulation roller 66 (preventing member) rotates on the horizontal guiding surface 231*c* (preventing position) as it is running on the horizontal guiding surface 231*c* which is moving in the direction indicated by the arrow mark Z. Eventually, the border line 231*h* between the horizontal guiding surface 231*c* and slant guiding surface 231*d* moves past the regulating roller 66 (preventing member), and the slant guiding surface 231*d* comes into contact with the regulating roller 66. Thus, the bottom guide 263 is made to rotationally move by its own weight in the direction indicated by the arrow mark R1 in FIG. 18 about the rotational shaft 61*c* of the registration roller 61*a*, causing its front end portion to move into the storing portion 231*j* which is inward adjacencies of the rear portion 231*f*1 of the feeding-conveying cassette 131 (cassette interior).

When the regulation roller 66 rotates in contact with the horizontal guiding surface 231*c* or slant guiding surface 231*d* as it is running on the two surfaces 231*c* or 231*d*, the bottom guide 263 remains pressed upon the two surfaces 231*c* or 231*d*, respectively, by its own weight. Also in this embodiment, the bottom guide 263 is provided with a bent portion 263*b*, like the bent portion 63*b* in the first embodiment, which is for causing a sheet 7 of recording medium to change in conveyance direction, in coordination with the top guide 64*a* of the front guide 64 as soon as the sheet 7 is fed into the main assembly of the image forming apparatus 1 from the feeding-conveying cassette 231 (cassette).

Further, referring to FIG. 8, the casing 2, top guide of the front guide 64 of the front guide 64 as a conveyance guide, and bottom guide 67 as a conveyance guide, are provided with slits (openings) 2*a*, 64*b* and 67*a*, respectively. Thus, the interior of the conveyance passage S through which a sheet of recording medium is conveyed is lit by the ambient light which enters the conveyance passage S through the slits 2*a*,

64*b* and 67*a*, making it easier for the user to see the interior of the conveyance passage S.

<Action of Means for Rotationally Moving Bottom Guide>

Next, referring to FIGS. 17 and 18, the action of the means for rotationally moving the bottom guide 263 is described about. Referring to FIG. 18, the bottom guide 263 rotatably supports the rotational shaft 260*c* of the conveyance roller 260*a*, and the rotational shaft feeding-conveying roller 230.

Referring to FIG. 18, when the bottom guide 263 is in its retraction position, the conveyance roller 260*a*, rotational shaft 260*c* of the conveyance roller 260*a*, feeding-conveying roller 230, and the rotational shaft 232 of the feeding-conveying roller 230 are in their retraction positions together.

Referring to FIG. 18, in this embodiment, as the feeding-conveying cassette 31 in the main assembly of the image forming apparatus 1 is drawn by a user in the direction indicated by the arrow mark Z in FIG. 18, not only the bottom guide 263, but also, the conveyance roller 260*a*, rotational shaft 260*c* of the conveyance roller 260*a*, feeding-conveying roller 230, and rotational shaft 232 of the feeding-conveying roller 230 move together into their retraction positions as shown in FIG. 18.

Thus, the bottom guide 263 which includes the bent portion 263*b* (a part of the conveyance passage S shown in FIG. 18), moves away from the top guide 62. Consequently, the conveyance passage S is exposed. Moreover, the conveyance roller 260*a*, rotational shaft 260*c* of the conveyance roller 260*a*, feeding-conveying roller 230, and rotational shaft 232 of the feeding-conveying roller 230 move away (retract) with the bottom guide 263 from their counterparts. Thus, the conveyance passage S is exposed.

Further, as the feeding-conveying cassette 231 in the casing 2 of the main assembly of the image forming apparatus 1 is drawn outward by a user, the bottom guide 263 having the bent portion 263*b*, which is a part of the conveyance passage S into which a sheet 7 of recording medium is fed from the feeding-conveying cassette 231, rotationally moves in such a manner that its front portion moves into the storing portion 231*j*, which is in the inward adjacencies of the rear portion 231*f*1 of the bottom plate 231*f* of the feeding-conveying cassette 231 (cassette interior).

The feeding-conveying cassette 231 in this embodiment has no rear plate; it is open at its rear end. Further, the conveyance roller 260*a*, the rotational shaft 260*c* of the conveyance roller 260*a*, feeding-conveying roller 230, and rotational shaft 232 of the feeding-conveying roller 230 are integral parts of the bottom guide 263. Thus, they move with the bottom guide 263 into the storing portion 231*j* which is in the inward adjacencies of the rear end portion 231*f*1 of the bottom plate 231*f* of the feeding-conveying cassette 231 (cassette interior).

Consequently, the entire range of the conveyance passage S in terms of the widthwise direction of a sheet 7 of recording medium is exposed. Thus, this embodiment is superior to each of the preceding embodiments in terms of the accessibility to the conveyance passage S from the underside of the passage S. That is, this embodiment makes it even easier for a user to remove a jammed sheet 7 of recording medium in the conveyance passage S having the bent portion which causes a sheet 7 of recording medium to U-turn (causes sheet 7 to move leftward in FIG. 1) as soon as the sheet 7 is fed into the conveyance passage S from the feeding-conveying cassette 231 than any of the preceding embodiments.

By the way, the separating portion 231*b*, separation pad holder 231*b*1, separation pad 231*b*2, bottom plate 231*f*, border line 231*h*, pair of conveyance roller 260, and conveyance roller 260*b* shown in FIGS. 15-18 correspond to the following members, one for one, in the first embodiment described above. That is, they correspond to the separating portion 31*b*, separation pad holder 31*b*1, separation pad 31*b*2, bottom plate 31*f*, border line 31*h*, pair of conveyance rollers 60, and conveyance roller 60*b*, respectively, in the first embodiment described above. Each of these members is similar in structure and effect as the counterpart in the first embodiment, and therefore, is not described. The other structural members in this embodiment are also similar in structure to the counterparts in each of the preceding embodiments, and can provide similar effects as those which can be provided by the counterparts.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-085650 filed on Apr. 22, 2016, which is hereby incorporated by reference herein in its entirety.

What is claimed is:

1. An image forming apparatus comprising:

a casing;

a process unit detachably mounted to said casing and configured to form a developer image on a recording material, the process unit including a photosensitive member extending in a direction crossing a vertical direction;

an exposing unit configured to expose said photosensitive member to light;

a cassette detachably mounted to said casing and configured to accommodate the recording material to be fed to said process unit;

a first feeding rotatable member configured to separate and feed the recording material from said cassette;

a second feeding rotatable member, having a rotational shaft and a roller, configured to feed the recording material from said first feeding rotatable member to said process unit; and a feeding guide provided in said casing and configured to guide the recording material moving from said cassette to said process unit, said feeding guide including an upper guide configured to guide an upper surface of the recording material and a lower guide configured to guide a lower surface of the recording material, said lower guide provided on said rotational shaft and on an upstream side of said rotational shaft with respect to a feeding direction of the recording material, wherein said exposing unit is disposed above said first feeding rotatable member, wherein said process unit is disposed at a position which is the same as that of said exposing unit in the vertical direction and which is downstream, with respect to the feeding direction of the recording material, of said exposing unit in a horizontal direction, wherein said cassette is disposed below said first feeding rotatable member, wherein said feeding guide is disposed between said exposing unit and said cassette in the vertical direction, and wherein when said cassette is drawn out of said casing, said lower guide moves about said rotational shaft to an accommodating portion in said cassette.

2. The image forming apparatus according to claim 1, further comprising a moving device configured to move said lower guide to said accommodating portion.

3. The image forming apparatus according to claim 2, wherein said moving device moves said lower guide to the accommodating portion in interrelation with said cassette being drawn out of said casing.

4. The image forming apparatus according to claim 1, wherein said lower guide includes at least one of said first feeding rotatable member and said second feeding rotatable member configured to feed the recording material from said first feeding rotatable member to said process unit.

5. The image forming apparatus according to claim 1, wherein said feeding guide is provided with a curved portion configured to change the feeding direction of the recording material fed from said cassette to an opposite direction.

6. The image forming apparatus according to claim 1, wherein said casing and said feeding guide are provided with transparent light slits to permit observation of a feeding path of the recording material.

7. An image forming apparatus comprising:

a casing;

a process unit detachably mounted to said casing and configured to form a developer image on a recording material, the process unit including a photosensitive member extending in a direction crossing a vertical direction;

an exposing unit configured to expose said photosensitive member to light;

a cassette detachably mounted to said casing and configured to accommodate the recording material to be fed to said process unit;

a first feeding rotatable member configured to separate and feed the recording material from said cassette;

a second feeding rotatable member, having a rotational shaft and a roller, configured to feed the recording material from said first feeding rotatable member;

a feeding guide provided in said casing and configured to guide the recording material moving from said cassette to said process unit, said feeding guide including an upper guide configured to guide an upper surface of the recording material and a lower guide configured to guide a lower surface of the recording material, said lower guide provided on said rotational shaft; and a moving device configured to move said lower guide to said accommodating portion, wherein said exposing unit is disposed above said first feeding rotatable member, wherein said process unit is disposed at a position which is the same as that of said exposing unit in the vertical direction and which is downstream, with respect to a feeding direction of the recording material, of said exposing unit in a horizontal direction, wherein said cassette is disposed below said first feeding rotatable member, wherein said feeding guide is disposed between said exposing unit and said cassette in the vertical direction, wherein, when said cassette is drawn out of said casing, said lower guide moves about said rotational shaft to an accommodating portion in said cassette, wherein said moving device includes a suppression member movable between a suppression position for suppressing movement of said lower guide and a release position for permitting movement of said lower guide, and wherein when said cassette is drawn out of said casing, said lower guide is moved to the accommodating portion by moving said suppression member to said release position.

8. The image forming apparatus according to claim 7, wherein said cassette is provided with a side surface plate having a horizontal guide surface and an inclined guide surface at a top portion of said side surface plate, wherein said lower guide is rotatable relative to said casing, and said suppression member is supported by said lower guide and movable relative to said horizontal guide surface and said inclined guide, and wherein said lower guide is rotated to the accommodating portion by said suppression member moving along said horizontal guide surface and said inclined guide surface in interrelation with said cassette being drawn out of said casing.

9. The image forming apparatus according to claim 8, wherein said suppression member includes a regulation roller rotatably supported by said lower guide, and said regulation roller travels along said horizontal guide surface and said inclined guide surface in interrelation with said cassette being drawn out of said casing.

10. The image forming apparatus according to claim 7, wherein said lower guide is rotatable relative to said casing, and said suppression member is rotatably supported by said lower guide and is provided with a regulating plate capable of being urged by an urging device to lock a locking portion with said casing, and wherein when an operating portion of said regulating plate is pushed against an urging force of said urging device, said locking portion is released from said casing to rotate said lower guide to the accommodating portion.

11. An image forming apparatus comprising:

a casing;

a process unit configured to form a developer image on a recording material and including a photosensitive member extending in a direction crossing a vertical direction;

a cassette detachably mounted to said casing and configured to accommodate the recording material to be fed to said process unit;

a feeding rotatable member, having a rotational shaft and a roller, configured to feed the recording material from said cassette to said process unit; and a feeding guide provided in said casing and configured to guide the recording material moving from said cassette to said process unit, said feeding guide including an upper guide configured to guide an upper surface of the recording material and a lower guide configured to guide a lower surface of the recording material, said lower guide provided on said rotational shaft and on an upstream side of said rotational shaft with respect to a feeding direction of the recording material, wherein said cassette is disposed below said feeding rotatable member, and wherein when said cassette is drawn out of said casing, said lower guide moves about said rotational shaft to an accommodating portion in said cassette.

* * * * *